US007232652B2

(12) United States Patent
Fukui

(10) Patent No.: US 7,232,652 B2
(45) Date of Patent: Jun. 19, 2007

(54) PHOTOTHERMOGRAPHIC MATERIAL AND IMAGE FORMING METHOD

(75) Inventor: Kouta Fukui, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/267,194

(22) Filed: Nov. 7, 2005

(65) Prior Publication Data

US 2006/0127826 A1 Jun. 15, 2006

(30) Foreign Application Priority Data

Dec. 15, 2004 (JP) ..... 2004-363428

(51) Int. Cl.
*G03C 1/00* (2006.01)
*G03C 1/005* (2006.01)
*G03C 1/494* (2006.01)
*G03C 1/06* (2006.01)

(52) U.S. Cl. ..... 430/617; 430/618; 430/619; 430/620; 430/627; 430/567; 430/964; 430/613; 430/614; 430/615

(58) Field of Classification Search ..... 430/617–620, 430/567, 964, 613–615, 627
See application file for complete search history.

(56) References Cited

U.S. PATENT DOCUMENTS

2004/0101794 A1* 5/2004 Usagawa et al. ..... 430/619
2005/0079457 A1* 4/2005 Naruyuki ..... 430/619

FOREIGN PATENT DOCUMENTS

JP A 11-352624 12/1999

* cited by examiner

*Primary Examiner*—Geraldina Visconti
(74) *Attorney, Agent, or Firm*—Margaret A. Burke; Sheldon J. Moss

(57) ABSTRACT

A photothermographic material including, on at least one side of a support, an image forming layer including at least a photosensitive silver halide, a first organic silver salt, a reducing agent, and a binder, and at least one non-photosensitive layer which is disposed on the same side as the image forming layer and farther from the support than the image forming layer, wherein 50% or more of a total projected area of the photosensitive silver halide is occupied by tabular grains having a silver iodide content of 40 mol % or higher and an aspect ratio of 2 or more, and the non-photosensitive layer comprises a second organic silver salt, and an image forming method using the same. The invention provides a photothermographic material and an image forming method excellent in image tone and image storability.

20 Claims, 1 Drawing Sheet

PHOTOTHERMOGRAPHIC MATERIAL AND IMAGE FORMING METHOD

CROSS-REFERENCE TO RELATED APPLICATION

This application claims priority under 35 USC 119 from Japanese Patent Application No. 2004-363428, the disclosure of which is incorporated by reference herein.

BACKGROUND OF THE INVENTION

1. Field of the Invention

The present invention relates to a photothermographic material and an image forming method. More particularly, the invention relates to a photothermographic material and an image forming method with excellent image tone and improved image stability.

2. Description of the Related Art

In recent years, in the field of films for medical diagnosis and in the field of films for graphic arts, there has been a strong desire for decreasing the amount of processing liquid waste from the viewpoints of protecting the environment and economy of space. Technology is therefore required for light sensitive photothermographic materials which can be exposed effectively by laser image setters or laser imagers and thermally developed to obtain clear black-toned images of high resolution and sharpness, for use in medical diagnostic applications and for use in photographic technical applications. The light sensitive photothermographic materials do not require liquid processing chemicals and can therefore be supplied to customers as a simpler and environmentally friendly thermal processing system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal image forming systems utilizing organic silver salts are described, for example, in U.S. Pat. Nos. 3,152,904 and 3,457,075, as well as in "Thermally Processed Silver Systems" by D. H. Klosterboer, appearing in "Imaging Processes and Materials", Neblette, 8th edition, edited by J. Sturge, V. Warlworth, and A. Shepp, Chapter 9, pages 279 to 291, 1989. All patents, patent publications, and non-patent literature cited in this specification are hereby expressly incorporated by reference herein. In particular, photothermographic materials generally have an image forming layer including a catalytically active amount of a photocatalyst (for example, silver halide), a reducing agent, a reducible silver salt (for example, an organic silver salt), and if necessary, a toner for controlling the color tone of developed silver images, dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region.

Photothermographic materials utilizing an organic silver salt have a great merit of containing all components necessary for image formation in the film in advance and being capable of forming images only by heating. However, on the other hand, after image formation, these chemical components remain as is in an unexposed portion, and reaction products remain where image forming reactions have occurred. These remaining chemical components and reaction products exert adverse influences on storage stability of the image, and thus further improvements in image stability are required.

Attempts have also been made at applying the photothermographic material as photosensitive material for photographing. The term "photosensitive material for photographing" used herein means a photosensitive material on which images are recorded by a plane exposure, rather than by writing the image information by a scanning exposure with a laser beam or the like. Conventionally, photosensitive materials for photographing are generally known in the field of wet developing photosensitive materials, and include films for medical use such as direct or indirect radiography films, mammography films and the like, various kinds of photomechanical films used in printing, industrial recording films, films for photographing with general-purpose cameras, and the like. For example, an X-ray photothermographic material coated on both sides using a blue fluorescent intensifying screen, a photothermographic material containing tabular silver iodobromide grains described in Japanese Patent Application Laid-Open (JP-A) No. 59-142539, and a photosensitive material for medical use containing tabular grains that have a high content of silver chloride and have (100) major faces, and that are coated on both sides of a support, which is described in JP-A No. 10-282606, are known. Further, photothermographic materials coated on both sides are also described in JP-A Nos. 2000-227642, 2001-22027, 2001-109101, and 2002-90941.

SUMMARY OF THE INVENTION

A first aspect of the invention is to provide a photothermographic material comprising, on at least one side of a support, an image forming layer comprising at least a photosensitive silver halide, a first organic silver salt, a reducing agent, and a binder, and at least one non-photosensitive layer which is disposed on the same side of the support as the image forming layer and farther from the support than the image forming layer, wherein 50% or more of a total projected area of the photosensitive silver halide is occupied by tabular grains having a silver iodide content of 40 mol % or higher and an aspect ratio of 2 or more, and the non-photosensitive layer comprises a second organic silver salt.

A second aspect of the invention is to provide an image forming method comprising: bringing the photothermographic material according to the first aspect into contact with a fluorescent intensifying screen; X-ray imagewise exposing the photothermographic material: and thermal developing the photothermographic material, wherein the fluorescent intensifying screen comprises a fluorescent substance in which 50% or more of the emission light has a wavelength of 350 nm to 420 nm.

DETAILED DESCRIPTION OF THE INVENTION

Figure 1:
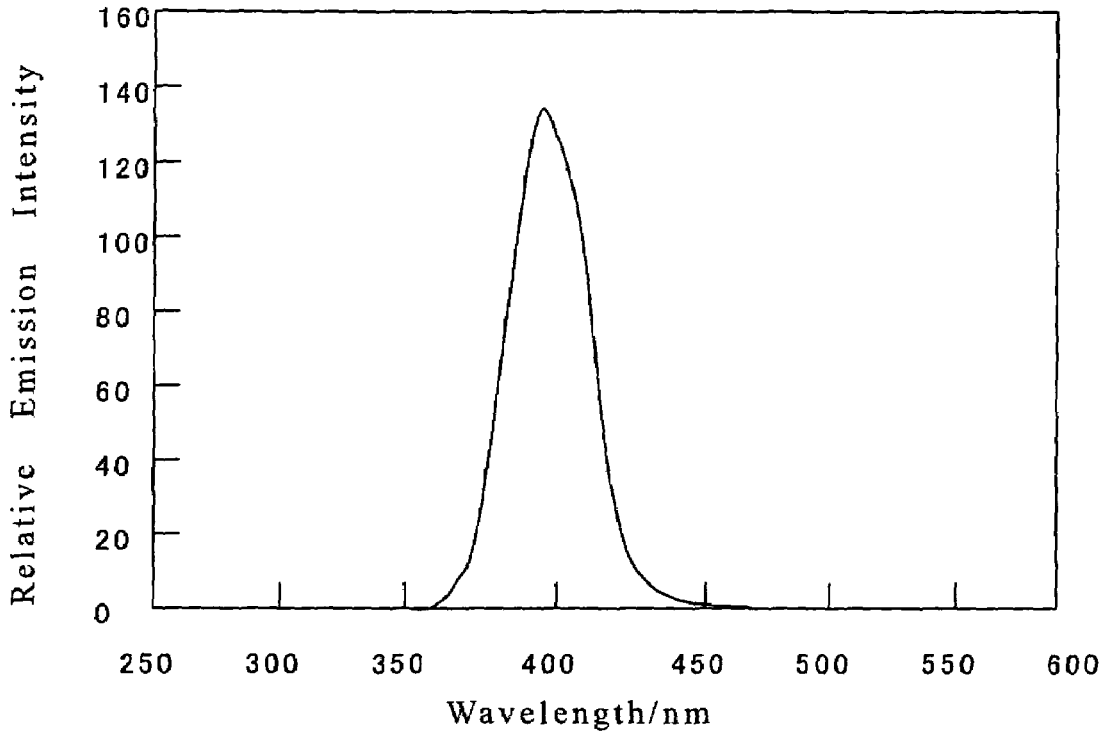
FIG. 1 is a diagram of a light emission spectrum of a fluorescent intensifying screen A.

A substantial increase in sensitivity is required in order to apply a photothermographic material for photographing use. However, it is clear that any means for increasing sensitivity further deteriorates image stability. The inventors have found means for improving image stability such as resistance to fingerprint stains before exposure, resistance to scratch defects after processing, and the like, while maintaining high sensitivity. An object of the present invention is to provide a photothermographic material, which exhibits high sensitivity suitable for photographing use, and an image forming method using the same.

The present invention is explained below in detail.

The photothermographic material of the present invention has, on at least one side of a support, an image forming layer containing at least a photosensitive silver halide, a first organic silver salt, a reducing agent, and a binder, and at least one non-photosensitive layer which is disposed on the same side of the support as the image forming layer and farther from the support than the image forming layer, wherein 50% or more of a total projected area of the photosensitive silver halide is occupied by tabular grains having a silver iodide content of 40 mol % or higher and an aspect ratio of 2 or more, and the non-photosensitive layer contains a second organic silver salt.

The image forming method of the present invention comprises: bringing the above-described photothermographic material into contact with a fluorescent intensifying screen, X-ray imagewise exposing the photothermographic material, and thermal developing the photothermographic material, wherein the fluorescent intensifying screen contains a fluorescent substance in which 50% or more of the emission light has a wavelength of 350 nm to 420 nm.

(Second Organic Silver Salt Incorporated in Non-photosensitive Layer)

The second organic silver salt, which is incorporated in the non-photosensitive layer of the present invention, preferably includes a silver salt of a fatty acid, a silver salt of a mercapto compound, a silver salt of a nitrogen-containing heterocyclic compound, a silver salt of an aromatic carboxylic acid, and a silver salt of a poly-carboxylic acid. More preferably, the second organic silver salt contained in the non-photosensitive layer is at least one selected from a silver salt of a fatty acid, a silver salt of, a mercapto compound, and a silver salt of a nitrogen-containing heterocyclic compound.

The non-photosensitive layer containing the second organic silver salt described above is at least one layer which is disposed on the same side of the support as the image forming layer and farther from the support than the image forming layer and includes the following surface protective layer, intermediate layer which is disposed between the surface protective layer and the image forming layer, and the like. The second organic silver salt is included in at least one layer of these non-photosensitive layers.

The silver salt of a fatty acid is a silver salt of an aliphatic carboxylic acid which has 1 to 30 carbon atoms and may be either linear or branched, saturated or unsaturated. Preferred examples of the silver salt of a fatty acid include silver lignocerate, silver behenate, silver arachidinate, silver stearate, silver oleate, silver linoleate, silver laurate, silver caprronate, silver myristate, silver palmitate, silver erucate, silver acetate, silver butyrate, silver propionate, silver valerate, silver enanthate, silver caprylate, silver pelargonate, silver decanoate, and mixtures thereof. Among them, particularly preferred are silver behenate, silver stearate, silver laurate, silver oleate, silver lignocerate, and silver arachidinate.

Preferably, the silver salt of a fatty acid is a silver salt of a saturated fatty acid having 11 to 27 carbon atoms. And more preferably, the silver salt of a fatty acid is at least one selected from the group consisting of silver behenate, silver stearate, silver arachidinate, and silver laurate.

Concerning the silver salt of a mercapto compound, preferred examples of the mercapto compound include an aliphatic mercapto compound and a heterocyclic mercapto compound. In the case of the aliphatic mercapto compound, the compound preferably has 10 to 30 carbon atoms, and more preferably 10 to 25 carbon atoms. The aliphatic mercapto compound may be either linear or branched, saturated or unsaturated, and unsubstituted or substituted. In the case where the aliphatic mercapto compound has a substituent, the substituent is not particularly limited, but an alkyl group is preferred.

Preferred aliphatic group for the aliphatic mercapto compound is an alkyl group, more preferably an alkyl group having 10 to 23 carbon atoms, which include substituted or unsubstituted, and linear or branched.

Representative examples of the silver salt of an aliphatic mercapto compound are described below, but are not limited to these compounds. For example, there are included a silver salt of an alkylthiol compound having 10 to 25 carbon atoms, and preferably a silver salt of an alkylthiol compound having 10 to 23 carbon atoms.

In the case of a silver salt of a heterocyclic mercapto compound, preferred examples of the heterocycle include a nitrogen-containing heterocycle, a sulfur-containing heterocycle, an oxygen-containing heterocycle, and a selenium-containing heterocycle, more preferred are a nitrogen-containing heterocycle, a sulfur-containing heterocycle, and an oxygen-containing heterocycle. Specific examples of the silver salt of a nitrogen-containing heterocyclic mercapto compound are described below, but are not limited to these examples.

A silver salt of 3-mercapto-4-phenyl-1,2,4-triazole,
a silver salt of 2-mercapto-benzimidazole,
a silver salt of 2-mercapto-5-aminothiazole,
a silver salt of mercaptotriazine,
a silver salt of 2-mercaptobenzoxazole,
a silver salt of the compound described in U.S. Pat. No. 4,123,274 (Knight, et al) (for example, a silver salt of 1,2,4-mercaptothiazole derivative, a silver salt of 3-amino-5-benzylthio-1,2,4-thiazole), and a silver salt of a thione compound (for example, a silver salt of 3-(2-carboxyethyl)-4-methyl-4-thiazoline-2-thione described in U.S. Pat. No. 3,785,830 (Sullivan, et al)).

Concerning the silver salt of a nitrogen-containing heterocyclic compound, specific examples of the nitrogen-containing heterocyclic compound include, but are not limited to these examples, azoles, oxazoles, thiazoles, thiazolines, imidazoles, diazoles, pyridines, indolizines, and triazines. Among them, more preferred are indolizines, imidazoles, and azoles. Preferred examples of the azoles include, triazole, tetrazole, and their derivatives. More preferred are benzimidazoles and derivatives thereof, and benzotriazole and derivatives thereof. Preferred example of the indolizines is a triazaindolizine derivative.

Representative examples of the nitrogen-containing heterocyclic compound further include, but are not limited to these examples, 1,2,4-triazole, benzotriazoles and derivatives thereof, and preferred are benzotriazole, methylbenzotriazole, and 5-chlorobenzotriazole. Further, 1H-tetrazole compounds such as phenylmercaptotetrazole described in U.S. Pat. No. 4,220,709 (de Mauriac), and imidazole and imidazole derivatives described in U.S. Pat. No. 4,260,677 (Winslow, et al) can be described, and benzimidazole and nitrobenzimidazole are preferred. As a triazaindolizine derivative, preferred is 5-methyl-7-hydroxy-1,3,5-triazaindolizine, but the invention is not limited to the compound.

Concerning the silver salt of an aromatic carboxylic acid, the aromatic carboxylic acid is an unsubstituted or substituted benzenecarboxylic acid where the substituent is not particularly limited. Preferred are benzoic acid and derivatives thereof, and salicylic acid and derivatives thereof.

The silver salt of a poly-carboxylic acid is a silver salt of a polyvalent carboxylic acid. A silver salt of a low-molecular poly-carboxylic acid is represented by the following formula (I).

$$M^1O_2C\text{-}L^1\text{-}CO_2M^2 \qquad \text{Formula (I)}$$

In formula (I), $L^1$ represents an alkylene group, an alkenylene group, an alkynylene group, a cycloalkylene group, an arylene group, a divalent heterocyclic group, a divalent group selected from —C(=O)—, —O—, —S—, —S(=O)—, —S(=O)$_2$—, and —N($R^1$)—, or a divalent group formed by combining these groups. $L^1$ may further have a substituent. $R^1$ represents a hydrogen atom or a substituent. $M^1$ and $M^2$ each independently represent a hydrogen atom or a counter ion where at least one of $M^1$ and $M^2$ represents a silver ion (I). Furthermore, the compound represented by formula (I) may further have a carboxy group or a salt thereof.

Specific examples of the compound mentioned above include, but are not limited to these examples, the compounds represented by chemical formulae Nos. 2 to 16 in paragraph Nos. 0024 to 0044 of JP-A No. 2003-330139.

Preferred examples of the carboxylic acid used for forming a silver salt of a low-molecular poly-carboxylic acid include phthalic acid, isophthalic acid, terephthalic acid, malic acid, citric acid, malonic acid, succinic acid, maleic acid, fumaric acid, hemimellitic acid, trimellitic acid, trimesic acid, mellophanic acid, prehnitic acid, pyromellitic acid, oxalic acid, adipic acid, gultaric acid, pimelic acid, suberic acid, azelaic acid, sebacic acid, and naphthalenedicarboxylic acid. Among them, particularly preferred are phthalic acid, succinic acid, adipic acid, glutaric acid, and naphthalenedicarboxylic acid. With respect to plural carboxylic acids, at least one of the carboxylic acids forms a silver salt.

A silver salt of a high-molecular poly-carboxylic acid is a silver salt of a polymer having a repeating unit derived from a monomer containing a carboxy group. Preferred compound can be represented by the following formula (II).

$$-(A)_a-(B)_b- \qquad \text{Formula (II)}$$

In formula (II), A represents a repeating unit derived from a monomer containing a carboxy group. B represents a repeating unit derived from an ethylenic unsaturated monomer except A. a represents a number of from 5 to 100 in terms of % by weight. b represents a number of from 0 to 95 in terms of % by weight. a+b is equal to 100% by weight.

Preferably, a is a number of from 50 to 100 in terms of % by weight, b is a number of from 0 to 50 in terms of % by weight, and a+b is equal to 100% by weight.

Specifically, the detail explanation are mentioned in paragraph Nos. 0013 to 0074 of JP-A No. 2003-330137.

Specific examples of the carboxylic acid include the compounds described below, but are not limited to these examples. The silver salt formed with the said carboxylic acid is a silver salt of a high-molecular poly-carboxylic acid, which may have at least one silver carboxylate in a molecule.

P-1

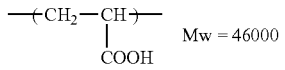

P-2

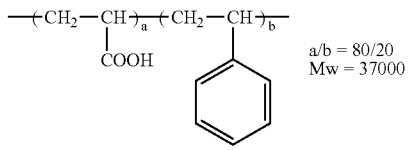

P-3

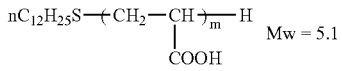

P-4

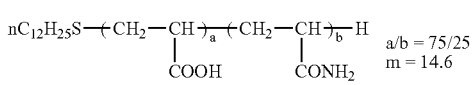

P-5

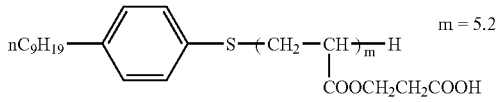

P-6

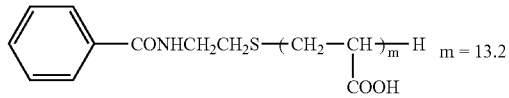

Among the organic silver salts described above, preferred examples of the silver salt of a fatty acid include silver behenate, silver stearate, silver laurate, silver oleate, silver lignocerate, and silver arachidinate. Preferred examples of the silver salt of a mercapto compound include a silver salt of 3-mercapto-4-phenyl-1,2,4-triazole, a silver salt of 2-mercapto-benzimidazole, and a silver salt of 2-mercapto-5-aminothiazole. Preferred examples of the silver salt of a nitrogen-containing heterocyclic compound include a silver salt of benzotriazole, a silver salt of methylbenzotriazole, a silver salt of benzimidazole, a silver salt of nitrobenzimidazole, and a silver salt of 5-methyl-7-hydroxy-1,3,5-triazaindolizine. Preferred examples of the silver salt of a poly-carboxylic acid include silver phthalate, silver succinate, silver adipate, silver glutarate, and silver naphthalenedicarboxylate. Preferred examples of the silver salt of a high-molecular poly-carboxylic acid include a silver salt of the compound selected from P-1, P-3, and P-5 mentioned above.

Syntheses of the silver salt of a fatty acid and the silver salt of an aliphatic mercapto compound can be carried out according to the conventional methods known in the art. For example, an aliphatic mercapto compound is melted in water by heating at a temperature above the melting point (generally, from 10° C. to 90° C.), and then a sodium salt thereof is formed with sodium hydroxide. Thereafter, the sodium salt is reacted with silver nitrate to form crystal of a silver salt of an aliphatic mercapto compound. The obtained silver salt can be dispersed using a suitable dispersing agent to prepare a dispersion thereof. In this preparing process for forming crystal of a silver salt of a fatty acid or a silver salt of an aliphatic mercapto compound, dispersion of the silver salt of a fatty acid or silver salt of an aliphatic mercapto compound may be performed in the presence of hydrophilic colloid such as gelatin. Another method for bringing the silver salt comprises a step of adding a fatty acid or an aliphatic mercapto compound in a reaction vessel and thereto adding silver nitrate.

A silver salt of a heterocyclic mercapto compound and a silver salt of a low-molecular poly-carboxylic acid can be prepared similarly. As an alternative method, for example, preparation can be easily performed for technician in the art, according to the method described in "Jikken Kagaku Koza" (Lecture Series on Experimental Chemistry), 4th Ed, vol. 22, pp. 1 to 43, and pp. 193 to 227. edited by the Chemical Society of Japan, and the references cited above. A silver salt of a nitrogen-containing heterocyclic compound and a silver salt of a heterocyclic mercapto compound can also be prepared by the method described in JP-A No. 1-100177.

A silver salt of a high-molecular poly-carboxylic acid can be prepared by a similar method described above.

The second organic silver salt used for the non-photosensitive layer of the present invention is added in an amount of from 0.001 g/m$^2$ to 3 g/m$^2$, in terms of a silver amount, more preferably from 0.005 g/m$^2$ to 1 g/m$^2$, and even more preferably from 0.01 g/m$^2$ to 0.5 g/m$^2$.

Measurement of silver potentials of a dispersion or an aqueous solution of the second organic silver salt used for the non-photosensitive layer of the present invention is carried out as follows; a silver electrode is used as an electrode, and the potential difference of the sample is measured using a saturated calomel electrode as a reference electrode at 40° C. while adjusting the pH thereof at 6. Thereafter, the obtained potential is converted to the value based on a standard hydrogen electrode as a reference electrode. The silver potential is preferably from +50 mV to +700 mV (with respect to a standard hydrogen electrode), more preferably from +250 mV to +650 mV, and particularly preferably from +400 mV to +600 mV.

(First Organic Silver Salt in the Image Forming Layer)

1) Composition

The first organic silver salt which can be used in the present invention is relatively stable to light but serves as to supply silver ions and forms silver images when heated to 80° C. or higher in the presence of an exposed photosensitive silver halide and a reducing agent. The non-photosensitive organic silver salt may be any material containing a source capable of supplying silver ions that are reducible by a reducing agent. Such a non-photosensitive organic silver salt is disclosed, for example, in Japanese Patent Application Laid-Open (JP-A) No. 10-62899 (paragraph Nos. 0048 to 0049), European Patent (EP) No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver capronate, silver myristate, silver palmitate, silver erucate, and mixtures thereof.

In the invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the first organic silver salt usable in the invention and it may be needle-like, bar-like, tabular, or flake shaped.

In the invention, a flake shaped organic silver salt is preferred. Short needle-like, rectangular, cuboidal, or potato-like indefinite shaped particles with the major axis to minor axis ratio being lower than 5 are also used preferably. Such organic silver particles suffer less from fogging during thermal development compared with long needle-like particles with the major axis to minor axis length ratio of 5 or higher. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably, from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the first organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of the organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing is used preferably for controlling photographic properties.

4) Addition Amount

While the first organic silver salt according to the invention can be used in a desired amount, a total amount of coated silver including silver halide is preferably in a range of from 0.1 g/m$^2$ to 5.0 g/m$^2$, more preferably from 0.3 g/m$^2$ to 3.0 g/m$^2$, and even more preferably from 0.5 g/m$^2$ to 2.0 g/m$^2$.

In particular, in order to improve image storability, the total amount of coated silver is preferably 1.8 mg/m$^2$ or less, and more preferably 1.6 mg/m$^2$ or less. In the case where a preferable reducing agent in the invention is used, it is possible to obtain a sufficient image density by even such a low amount of silver.

(Reducing Agent)

The photothermographic material of the present invention preferably contains a reducing agent for organic silver salts as a thermal developing agent. The reducing agent for organic silver salts can be any substance (preferably, organic substance) capable of reducing silver ions into metallic silver. Examples of the reducing agent are described in JP-A No. 11-65021 (column Nos. 0043 to 0045) and EP No. 0803764 (p. 7, line 34 to p. 18, line 12).

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

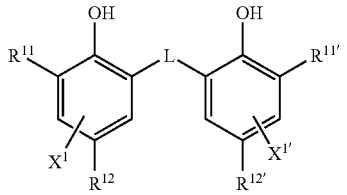

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —CHR$^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

In the following description, when referred to as an alkyl group, it means that the alkyl group contains a cycloalkyl group, as far as it is not mentioned specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

3) L

L represents an —S— group or a —CHR$^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, a methyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group.

And, a group which has a C═C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimethyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ preferably is a hydrogen atom.

In the case where $R^{11}$ and $R^{11'}$ are not a tertiary alkyl group, $R^{13}$ preferably is a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more kinds of reducing agents in combination, it is preferred to use two or more kinds of reducing agents in combination depending on the purpose.

Specific examples of the reducing agents of the invention including the compounds represented by formula (R) according to the invention are shown below, but the invention is not restricted to these.

R-1

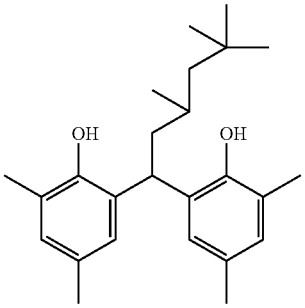

R-2

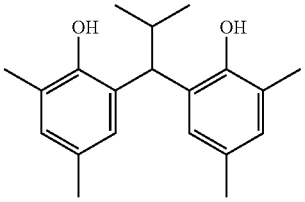

R-3

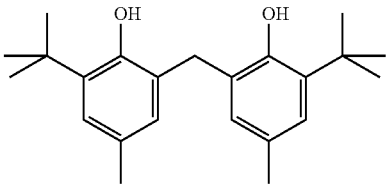

R-4

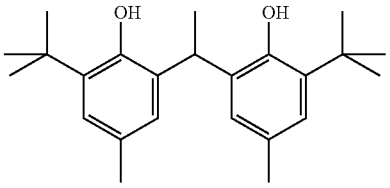

R-5

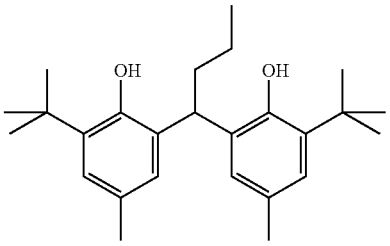

R-6

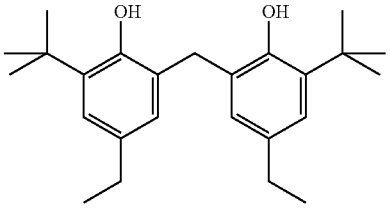

-continued

R-7

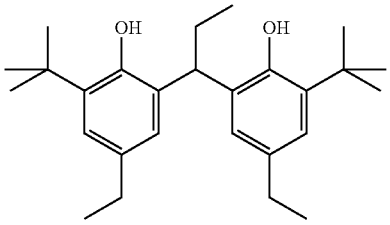

R-8

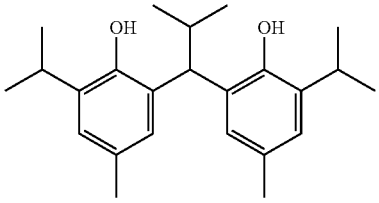

R-9

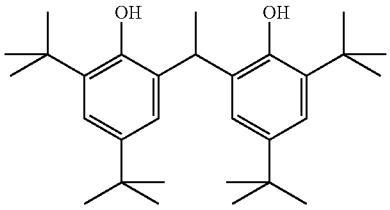

R-10

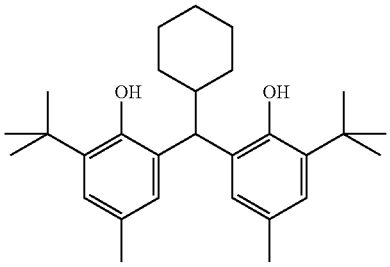

R-11

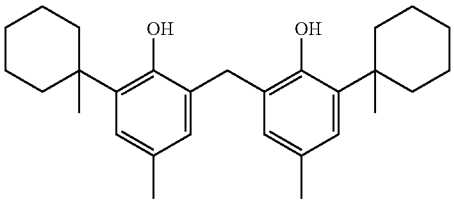

R-12

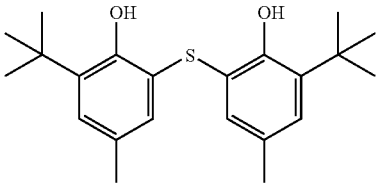

R-13

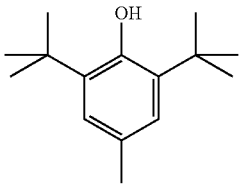

-continued

R-14

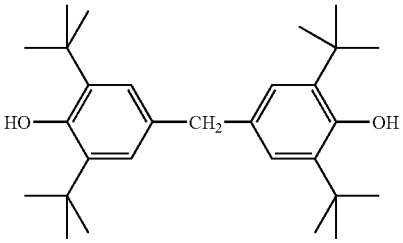

R-15

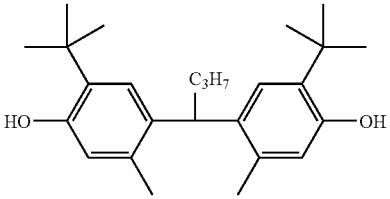

R-16

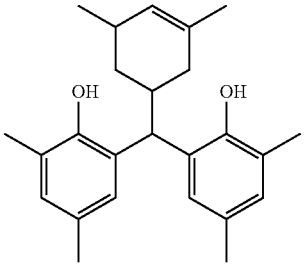

R-17

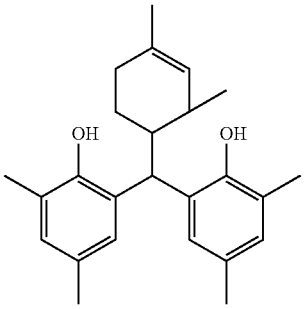

R-18

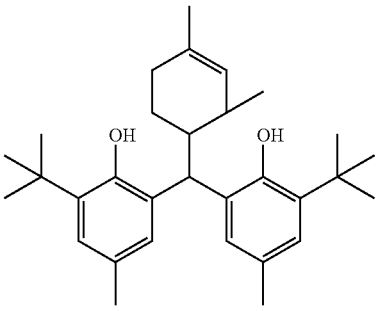

As preferred reducing agents of the invention other than those above, there can be mentioned compounds disclosed in JP-A Nos. 2001-188314, 2001-209145, 2001-350235, and 2002-156727, and EP No. 1278101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into a photothermographic material by being added into the coating solution, such as in the form of a solution, an emulsified dispersion, a solid fine particle dispersion, or the like.

As well known emulsified dispersing method, there can be mentioned a method comprising dissolving the reducing agent in an oil such as dibutylphthalate, tricresylphosphate, dioctylsebacate, tri(2-ethylhexyl)phosphate, or the like, using an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsified dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm.

It is practically acceptable so long as Zr is incorporated in the photothermographic material in an amount of 0.5 mg or less per 1 g of silver.

Preferably, an antiseptic (for instance, benzisothiazolinone sodium salt) is added in an aqueous dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

(Development Accelerator)

In the photothermographic material of the invention, a development accelerator is preferably used. As a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. Further, phenolic compounds described in JP-A Nos. 2002-311533 and 2002-341484 are also preferable. Naphtholic compounds described in JP-A No. 2003-66558 are particularly preferable. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a high boiling solvent which is solid at a normal temperature and an auxiliary solvent at a low boiling point, or to add as a so-called oilless emulsified dispersion not using the high boiling solvent.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) or (A-2).

$$Q_1\text{-NHNH-}Q_2 \qquad \text{Formula (A-1)}$$

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5 to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from each other.

Next, preferred range for the compound represented by formula (A-1) is to be described. A 5 or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated heterocycle are more preferred.

Further, $Q_2$ is preferably a carbamoyl group and, particularly, a carbamoyl group having a hydrogen atom on the nitrogen atom is particularly preferred.

Formula (A-2)

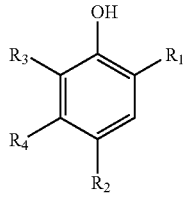

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

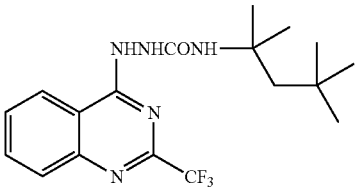

A-2

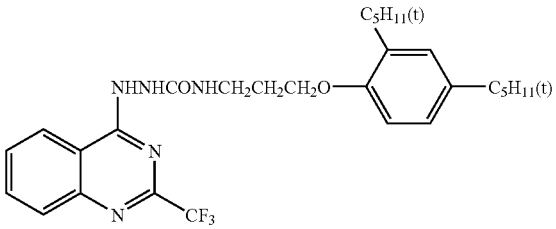

A-3

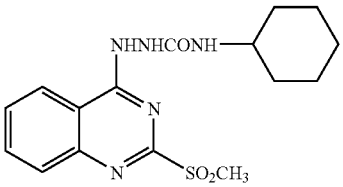

A-4

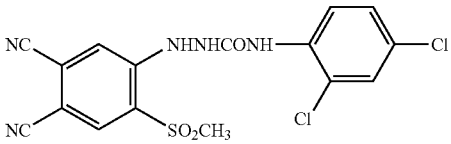

A-5

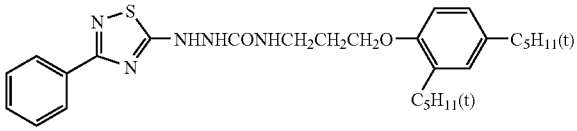

A-6

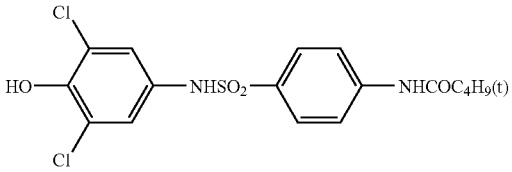

A-7

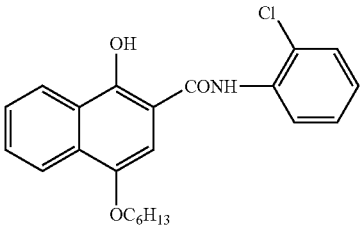

-continued

A-8

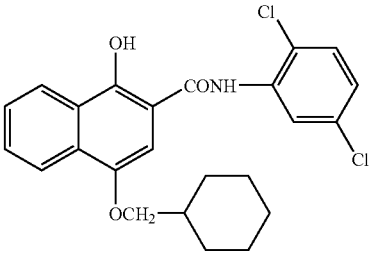

A-9

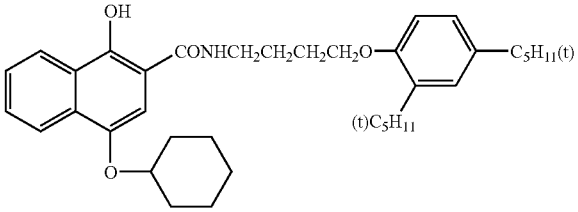

A-10

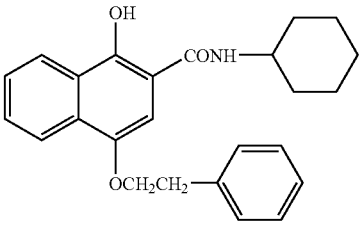

A-11

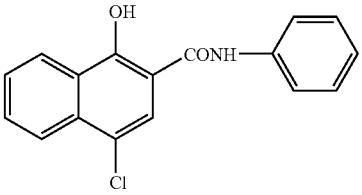

A-12

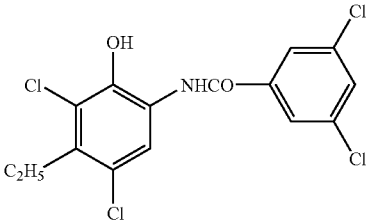

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having >N—H moiety but being blocked in the form of >N—Ra (where, Ra represents a substituent other than H)), a urethane group (not having >N—H moiety but being blocked in the form of >N—Ra (where, Ra represents a substituent other than H)), and a ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

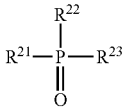

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxy group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ is an alkyl group, an aryl group, an alkoxy group, or an aryloxy group. Concerning the effect of the invention, it is preferred that at least one of $R^{21}$ to $R^{23}$ is an alkyl group or an aryl group, and more preferably, two or more of $R^{21}$ to $R^{23}$ are an alkyl group or an aryl group. From the viewpoint of low cost availability, it is preferred that $R^{21}$ to $R^{23}$ are of the same group.

Specific examples of the hydrogen bonding compound represented by formula (D) of the invention and others are shown below, but the invention is not limited thereto.

D-1

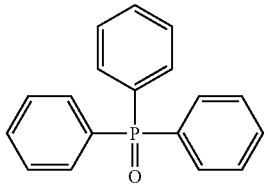

D-2

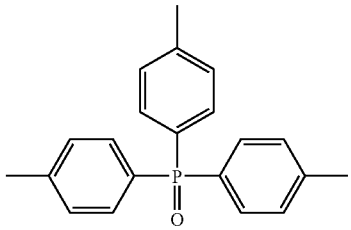

D-3

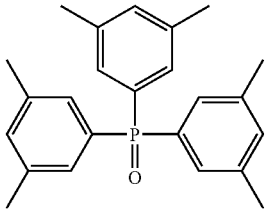

D-4

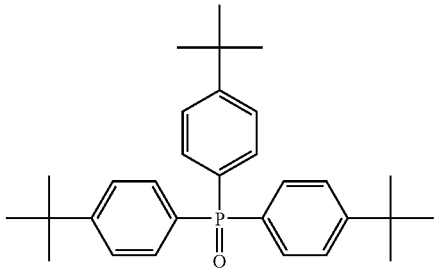

D-5

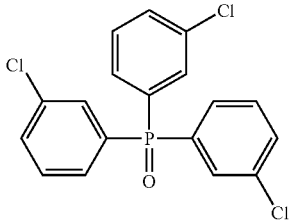

D-6

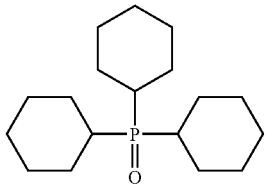

-continued

D-7

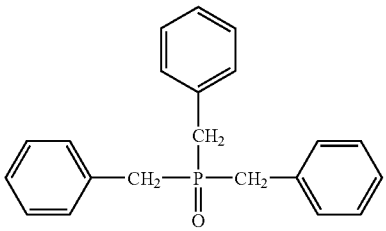

D-8

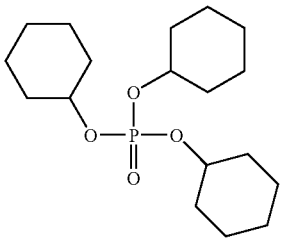

D-9

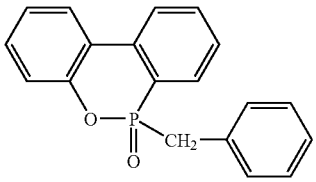

D-10

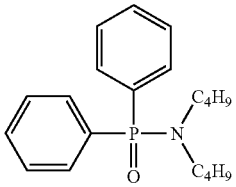

D-11

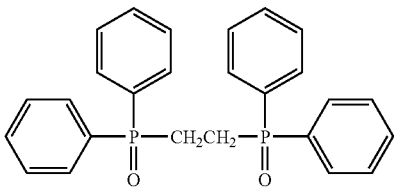

D-12

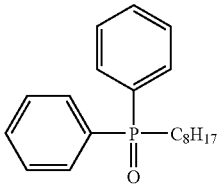

D-13

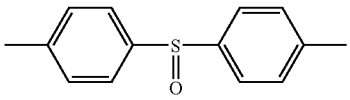

D-14

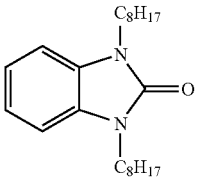

-continued

D-15

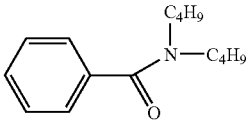

Specific examples of the hydrogen bonding compound other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsified dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Binder)

Any kind of polymer may be used as the binder for the image forming layer of the invention, as far as it has a glass transition temperature in a range of from 0° C. to 80° C. Suitable as the binder are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly(methacrylic acids), styrene-maleic anhydride copolymers, styrene-acrylonitrile copolymers, styrene-butadiene copolymers, poly(vinyl acetals) (e.g., poly (vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent, or emulsion to form a coating solution.

The glass transition temperature (Tg) of the binder is in a range of from 0° C. to 80° C., preferably from 10° C. to 70° C. and, more preferably from 15° C. to 60° C.

In the specification, Tg is calculated according to the following equation.

$$1/Tg=\Sigma(Xi/Tgi)$$

where the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more kinds of polymers depending on needs. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As water-miscible organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "aqueous solvent" is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60% RH $$=[(W1-W0)/W0]\times 100(\%\text{ by weight})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, in a range of from 0.01% by weight to 1.5% by weight, and is most preferably, from 0.02% by weight to 1% by weight.

The binder used in the invention is particularly preferably polymer capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodisperse particle diameter distribution.

From the viewpoint of controlling the physical properties of the coating solution, preferred mode of usage includes mixing two or more types of dispersed particles each having monodisperse particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer.

The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

<Examples of Latex>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-1A(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latexes>

Particularly preferable as the polymer latex for use in the invention are that of styrene-butadiene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range of from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above.

As the latex of styrene-butadiene copolymer preferably used in the invention, there can be mentioned P-3 to P-8, and P-15, or commercially available LACSTAR 3307B, LACSTAR 7132C, Nipol Lx416, and the like.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like. These hydrophilic polymers are added in an amount of 30% by weight or less, and preferably 20% by weight or less, with respect to the total weight of the binder incorporated in the image forming layer.

According to the invention, the layer containing organic silver salt (image forming layer) is preferably formed by using a polymer latex for the binder. According to the amount of the binder for the image forming layer, a mass ratio of total binder to organic silver salt (total binder/organic silver salt) is preferably in a range of from 1/10 to 10/1, more preferably from 1/3 to 5/1, and even more preferably from 1/1 to 3/1.

The image forming layer is, in general, a photosensitive layer (image forming layer) containing a photosensitive silver halide, i.e., the photosensitive silver salt; in such a case, a mass ratio of total binder to silver halide (total binder/silver halide) is in a range of 400 or lower and 5 or higher, and more preferably, 200 or lower and 10 or higher.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a crosslinking agent for crosslinking, a surfactant to improve coating ability, or the like.

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 50% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is preferably 50% by weight or higher, and more preferably 70% by weight or higher. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Photosensitive Silver Halide)

Concerning the photosensitive silver halide of the present invention, 50% or more of a total projected area of photosensitive silver halide grains is occupied by tabular grains having a silver iodide content of 40 mol % or higher and an aspect ratio of 2 or more.

Preferably 60% or more, more preferably 70% or more, and most preferably 80% or more of the total projected area is occupied by tabular grains having a silver iodide content of 40 mol % or higher and an aspect ratio of 2 or more.

The photosensitive silver halide grains used for the present invention are explained below in more detail.

1) Tabular Silver Halide Grain

The tabular grain used herein means a silver halide grain having two facing parallel principal planes (hereinafter referred as "tabular grain").

On viewing the tabular grain from the vertical direction with respect to the principal plane, the tabular gain often have a shape such as a hexagonal form, a triangle form, a square form, a rectangular form or a circular form with rounded corner. Any form beside the above forms may be used. However, in order to apply uniformly an epitaxial sensitization among grains, monodisperse in size and form is preferred.

The tabular silver halide grain used in the present invention is defined as a silver halide grain having an aspect ratio (equivalent circular diameter of the major plane/grain thickness) of 2 or more. The equivalent circular diameter of a tabular silver halide grain is determined from a diameter (equivalent circular diameter) of a circle having the same area as projected area of a silver halide grain, for example, measured by photomicrographs of transmission electron microscope image with a replica method. The grain thickness can not be easily derived from a length of the shadow of the replica because of their epitaxial junction portion. However, the thickness may be derived from the measurement of a length of the shadow of the replica before the formation of epitaxial junction portion. Or even after the formation of epitaxial junction portion, the grain thickness can be easily derived from electron photomicrographs of the cross section of sliced specimens of a coated sample containing tabular grains.

The tabular grain in the present invention has an aspect ratio of 2 or more, and preferably the tabular grain used in the present invention has an aspect ratio of 5 or more, more preferably 7 or more, and most preferably 10 or more.

2) Halogen Composition

Concerning the tabular silver halide grains used in the invention, silver halide grains having a high silver iodide content of 40 mol % or higher are used. Other components are not particularly limited and can be selected from silver halides such as silver chloride, silver bromide, and the like and organic silver salts such as silver thiocyanate, silver phosphate, and the like. Among them, silver bromide, silver chloride, and silver thiocyanate are preferably used. The silver iodide content used herein means a content of silver iodide comprised in silver halide grains including epitaxial portions.

Using such silver halide grains having a high silver iodide content, the photothermographic materials exhibiting excellent properties in image storability after thermal development, especially a remarkable depression of fog increase caused by light exposure can be attained.

The halogen composition of the tabular grains used in the present invention preferably has a silver iodide content of 80 mol % or higher, and most preferably 90 mol % or higher.

The X-ray diffraction method is well known in the art as for the technique of determination of halogen composition in silver halide crystals. The X-ray diffraction method is fully described in "X-Ray Diffraction Method" of Kiso Bunseki Kagaku Koza (Lecture Series on Basic Analytical Chemistry), No. 24. Normally, an angle of diffraction is measured by the powder method with copper K β radiation as a beam source.

The lattice constant a can be calculated from Bragg's equation by finding the angle of diffraction 2 θ as follows.

$$2d \sin \theta = \lambda$$

$$d = a/(h^2+k^2+l^2)^{1/2}$$

wherein, 2 θ is an angle of diffraction of (hkl) face, λ is a wavelength of X-ray beam used, d is spacing between (hkl) faces. The relation between the halogen composition of silver halide solid solution and the lattice constant a is already known (for example, described in T. H. James, "THE THEORY OF THE PHOTOGRAPHIC PROCESS, FOURTH EDITION" (Macmillan New York). Therefore, the halogen composition can be determined from the lattice constant obtained.

The tabular grain of the invention can assume any of a β phase or a γ phase. The term "β phase" described above means a high silver iodide structure having a wurtzite structure of a hexagonal system and the term "γ phase" means a high silver iodide structure having a zinc blend structure of a cubic crystal system. An average content of γ phase in the present invention is determined by a method presented by C. R. Berry. In the method, an average content of γ phase is calculated from the peak ratio of the intensity owing to γ phase (111) to that owing to β phase (100), (101), (002) in powder X ray diffraction method. Detail description, for example, is described in Physical Review, volume 161 (No. 3), pages 848 to 851 (1967).

Concerning the tabular grains used in the present invention, the distribution of the halogen composition in a host tabular grain may be uniform or the halogen composition may be changed stepwise, or it may be changed continuously.

Further, a silver halide grain having a core/shell structure can be preferably used. Preferred structure is a twofold to fivefold structure and, more preferably, core/shell grain having a twofold to fourfold structure can be used.

A core-high-silver iodide-structure which has a high content of silver iodide in the core part, and a shell-high-silver iodide-structure which has a high content of silver iodide in the shell part can also be preferably used. In order to attain the photothermographic material exhibiting excellent image storability after development and depression of fog increase caused by light exposure, tabular host grains having a higher silver iodide content are preferred, and more preferred are tabular grains having a silver iodide content of 90 mol % or higher.

3) Grain Size

Concerning the tabular grains used in the present invention, any grain size enough to reach the required high sensitivity can be selected. In the present invention, preferred silver halide grains are those having a mean equivalent spherical diameter of 0.3 μm to 5.0 μm, and more preferred are those having a mean equivalent spherical diameter of 0.35 μm to 3.0 μm. The term "equivalent spherical diameter" used here means a diameter of a sphere having the same volume as the volume of a silver halide grain.

Concerning the measurement method, an equivalent spherical diameter is calculated from measuring equivalent circular diameter and thickness similar to the aforesaid measurement of an aspect ratio. The smaller equivalent circular diameter and the thinner grain thickness may normally result in increasing the number of grains and broadening the distribution of epitaxial junctions among grains. Thereby, the effect of the present invention becomes more remarkable.

4) Epitaxial Junction Portion

The tabular silver halide grain according to the present invention has at least one epitaxial junction portion having a multifold structure. The multifold structure may be a twofold structure, threefold structure, or higher dimension of multifold structure. One example is a twofold structure consisted of a core part and a shell part, in which preferably the core part has a silver chloride content of 40 mol % or higher and the shell part has a silver chloride content of 30 mol % or lower, and more preferably the core part comprises silver chloride and the shell part comprises silver bromide.

Concerning the threefold structure, the epitaxial junction portion is consisted of a core part, an intermediate part, and a shell part, in which preferably at least one of the core part and the intermediate part has a silver iodide content of 4 mol % or higher. More preferably the intermediate part has a silver iodide content of 10 mol % or higher, and even more preferably the core part comprises silver chloride or silver bromide, the intermediate part comprises silver iodide, and the shell part comprises silver bromide, and most preferably the core part comprises silver chloride.

In the present invention, the epitaxial junction portion can be formed onto an apex portion, a major plane, or an edge portion of the tabular grain, and more preferably onto the apex portion. The tabular grain has at least one epitaxial junction portion, preferably two or more epitaxial junction portions, and more preferably four or more epitaxial junction portions.

The tabular grain having an epitaxial junction portion of the present invention preferably has a dislocation line. The dislocation line is sometimes formed accidentally in the epitaxial portion caused by the composition difference between the tabular host grain and the epitaxial portion, but the intended introduction of dislocation lines in the grains by controlling the condition for forming the epitaxial junction portion is more preferred.

Here, it is preferred that no dislocation line is substantially observed in the tabular host grain. The coexistence of the dislocation lines in both the tabular host grain and the epitaxial portion is not preferred because the efficiency of latent image formation is depressed to give low sensitivity.

The size of epitaxial junction portion according to the present invention, with respect to host grain portion, is preferably in a range of from 1 mol % to 60 mol %, based on mole of silver ion, more preferably from 3 mol % to 50 mol %, even more preferably from 5 mol % to 30 mol %, and most preferably from 10 mol % to 20 mol %.

5) Coating Amount

Generally, in the case of photothermographic material where silver halide are remained thereon after thermal development, the coating amount of silver halide is limited to a lower level in spite of the requirement for high sensitivity. It is because the increase of the coating amount of silver halide may result in decreasing the film transparency and deteriorating the image quality. However, according to the present invention, more amount of silver halide can be coated because thermal development can decrease haze of film caused by the residual silver halide. In the present invention, the preferred coating amount is in a range from 0.5 mol % to 100 mol %, per 1 mol of non-photosensitive organic silver salt, and more preferably from 5 mol % to 50 mol %.

6) Heavy Metal

The photosensitive silver halide grain of the invention preferably contains a heterometal other than silver atom in the grain. As the heterometal other than silver atom, metals or complexes of metals belonging to groups 3 to 11 of the periodic table (showing groups 1 to 18) are preferred. The metal or the center metal of the metal complex from groups 3 to 11 of the periodic table is preferably ferrum, rhodium, ruthenium, or iridium.

The metal complex may be used alone, or two or more kinds of complexes comprising identical or different species of metals may be used together. The content is preferably in a range from $1\times10^{-9}$ mol to $1\times10^{-3}$ mol per 1 mol of silver. The heavy metals, metal complexes and the addition method thereof are described in JP-A No. 7-225449, in paragraph Nos. 0018 to 0024 of JP-A No. 11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred. The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

7) Chemical Sensitization

The photosensitive silver halide in the present invention can be used without chemical sensitization, but is preferably chemically sensitized by at least one of a chalcogen sensitizing method, gold sensitizing method, and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea, or carboxymethyltrimethylthiourea), thioamides (e.g., thioacetamide), rhodanines (e.g., diethylrhodanine or 5-benzylydene-N-ethylrhodanine), phosphinesulfides (e.g., trimethylphosphinesulfide), thiohydantoins, 4-oxo-oxazolidin-2-thiones, disulfides or polysulfides (e.g., dimorphorinedisulfide, cystine, or lenthionine (1,2,3,5,6-pentathiepane)), polythionates, and sulfur element, and active gelatin can be used. Particularly, thiosulfates, thioureas, and rhodanines are preferred.

In selenium sensitization, unstable selenium compounds can be used. These unstable selenium compounds are described in Japanese Patent Application Publication (JP-B) Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea, or acetyltrimethylselemourea), selenoamides (e.g., selenoamide or N,N-diethylphenylselenoamide), phosphineselenides (e.g., triphenylphosphineselenide or pentafluorophenyltriphenylphosphineselenide), selenophosphates (e.g., tri-p-tolylselenophosphate or tri-n-butylselenophosphate), selenoketones (e.g., selenobenzophenone), isoselenocyanates, selenocarbonic acids, selenoesters, diacylselenides, or the like can be used.

Furthermore, non-unstable selenium compounds such as selenius acid, salts of selenocyanic acid, selenazoles, and selenides described in JP-B Nos. 46-4553 and 52-34492, and the like can also be used. Specifically, phosphineselenides, selenoureas, and salts of selenocyanic acids are preferred.

In tellurium sensitization, unstable tellurium compounds are used. Unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, 7-301880, and the like, can be used as a tellurium sensitizer.

As typical examples of a tellurium sensitizer, phosphinetellurides (e.g., butyl-diisopropylphosphinetelluride, tributylphosphinetelluride, tributoxyphosphinetelluride, or ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, or bis(ethoxycarmonyl)telluride), telluroureas (e.g., N,N'-dimethylethylenetellurourea or N,N'-diphenylethylenetellurourea), telluramides, or telluroesters may be used. Specifically, diacyl(di)tellurides and phosphinetellurides are preferred. Especially, the compounds described in paragraph No. 0030 of JP-A No. 11-65021 and compounds represented by formulae (II), (III), or (IV) in JP-A No. 5-313284 are preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. More specifically, chloroauric acid, potassium chloroaurate, potassium aurithiocyanate, gold sulfide, gold selenide, or the like can be used. In addition to these, the gold compounds described in U.S. Pat. Nos. 2,642,361, 5,049,484, 5,049,485, 5,169,751, and 5,252,455, Belg. Patent No. 691857, and the like can also be used.

Noble metal salts other than gold such as platinum, palladium, iridium and the like, which are described in Chimie et Pysique Photographique, written by P. Grafkides, (Paul Momtel, 5th ed., 1987) and Research Disclosure (vol. 307, Item 307105), can also be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The addition amount of chalcogen sensitizer used in the invention may vary depending on the silver halide grain used, the chemical ripening condition, and the like, and it is from $10^{-8}$ mol to $10^{-1}$ mol, and preferably from about $10^{-7}$ mol to about $10^{-2}$ mol, per 1 mol of silver halide.

Similarly, the addition amount of the gold sensitizer used in the invention may vary depending on various conditions and it is generally from $10^{-7}$ mol to $10^{-2}$ mol and, more preferably, from $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is from 3 to 10, and preferably from 4 to 9; and the temperature is from 20° C. to 95° C., and preferably from 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred. The reduction sensitizer may be added at any stage in the photosensitive emulsion producing process from crystal growth to the preparation step just before coating.

Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally from $10^{-7}$ mol to $10^{-1}$ mol and preferably, from $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

8) Compound That Can Be One-Electron-Oxidized to Provide a One-Electron Oxidation Product Which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is preferably a compound selected from the following Groups 1 or 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929).

The preferable ranges of these compounds are the same as the preferable ranges described in the quoted specifications.

Formula (1)

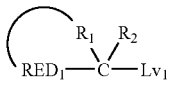

Formula (2)

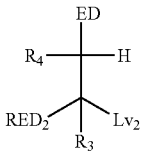

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

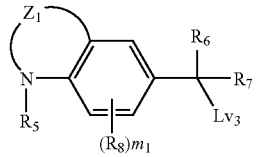

Formula (4)

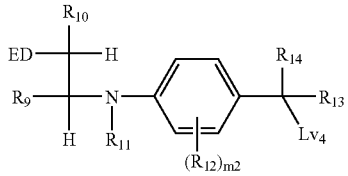

Formula (5)

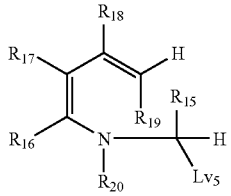

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bond to each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

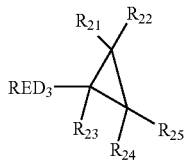

Formula (7)

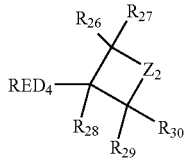

In formulae (6) and (7), $RED_3$ and $RED_4$ each independently represent a reducing group. $R_{21}$ to $R_{30}$ each independently represent a hydrogen atom or a substituent. $Z_2$ represents one selected from —$CR_{111}R_{112}$—, —$NR_{113}$—, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

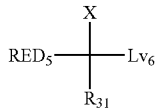

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Reaction formula (1)

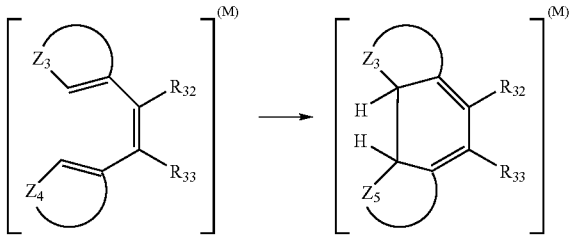

Formula (9)

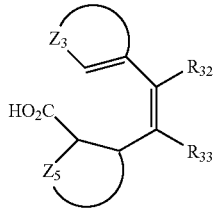

The compound represented by formula (9) is a compound that undergoes a bonding reaction represented by reaction formula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5 or 6-membered heterocycle with C═C. $Z_4$ represents a group to form a 5 or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5 or 6-membered cyclic aliphatic hydrocarbon group or heterocyclic group with C—C.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

$RED_6$-Q-Y Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

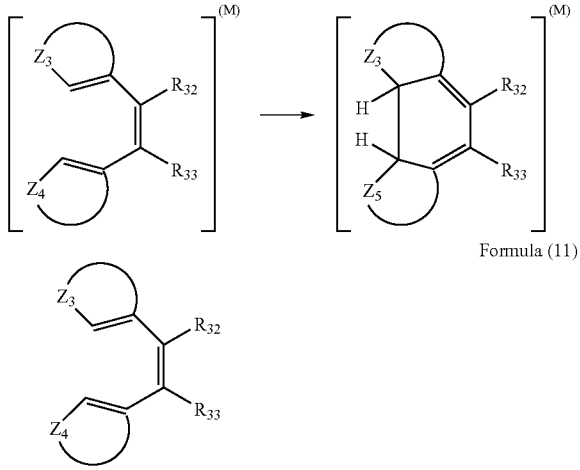

Formula (11)

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5 or 6-membered aryl group or heterocyclic group with C═C. $Z_5$ represents a group to form a 5 or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from each other.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used.

Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

$$(P\text{-}Q_1\text{-})_i\text{-}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

9) Compound Having Adsorptive Group and Reducing Group

The photothermographic material of the present invention preferably comprises a compound having an adsorptive group to silver halide and a reducing group in a molecule. It is preferred that the compound is represented by the following formula (I).

$$A\text{-}(W)n\text{-}B \qquad \text{Formula (I)}$$

In formula (I), A represents a group capable of adsorption to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also include a linear or cyclic thioamide group, thioureido group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (>NAg) or a heterocyclic group, having an —S— group, a —Se— group, a —Te— group or a =N— group as a partial structure of a heterocycle, and capable to coordinate to a silver ion by a coordinate bond. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (>NAg) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%:90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E½) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (I), a reducing group represented by B is preferably a residue which is obtained by removing one hydrogen atom from hydroxylamines, hydroxamic acids, hydroxyureas, hydroxysemicarbazides, reductones, phenols, acylhydrazines, carbamoylhydrazines, or 3-pyrazolidones.

The compound of formula (I) according to the present invention may have the ballasted group or polymer chain in it generally used in the non-moving photographic additives as a coupler. And as a polymer, for example, the polymer described in JP-A No. 1-100530 can be selected.

The compound of formula (I) according to the present invention may be bis or tris type of compound.

The molecular weight of the compound represented by formula (I) according to the present invention is preferably from 100 to 10000, more preferably from 120 to 1000, and particularly preferably from 150 to 500.

The examples of the compound represented by formula (I) according to the present invention are shown below, but the present invention is not limited in these.

(1)

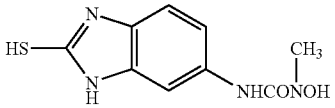

(2)

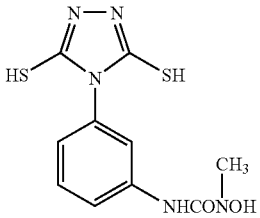

(3)

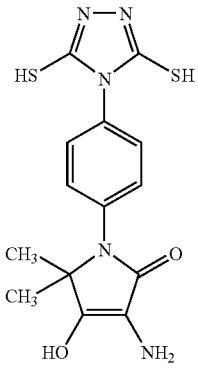

(4)

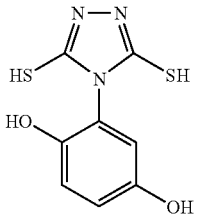

-continued (5)

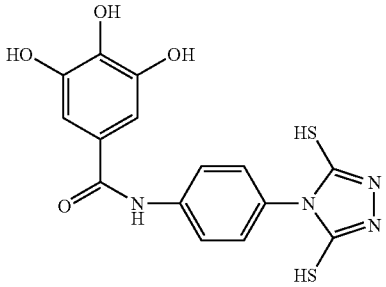

(6)

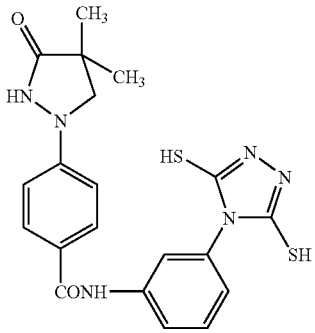

(7)

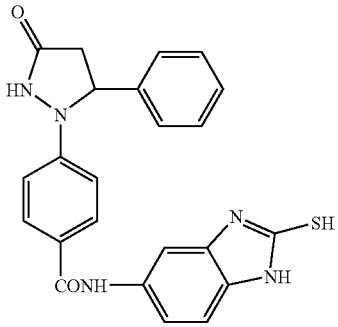

(8)

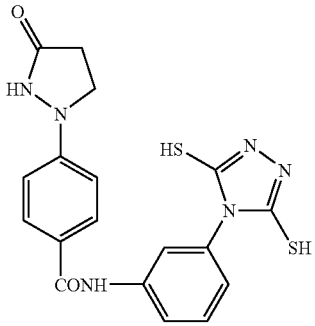

-continued (9)

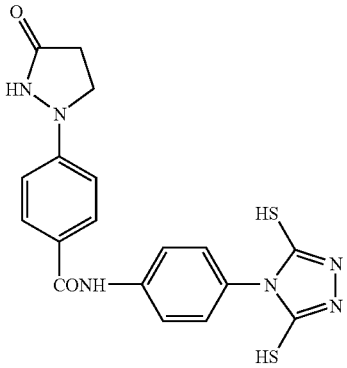

(10)

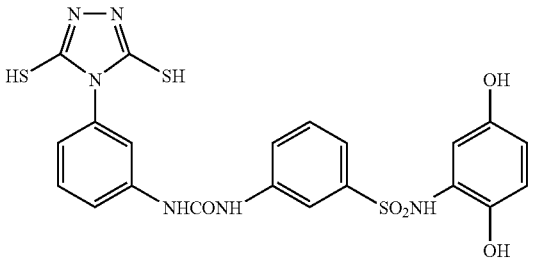

(11)

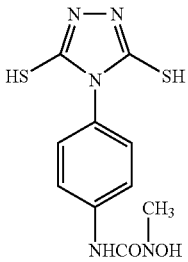

(12)

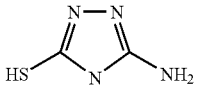

(13)

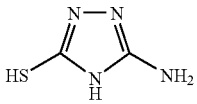

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

10) Compound Which Substantially Reduces Visible Light Absorption by Photosensitive Silver Halide After Thermal Development In the present invention, it is preferred that the photothermographic material contains a compound which substantially reduces visible light absorption by photosensitive silver halide after thermal development relative to that before thermal development.

In the present invention, it is particularly preferred that a silver iodide complex-forming agent is used as the compound which substantially reduces visible light absorption by photosensitive silver halide after thermal development.

<Silver Iodide Complex-forming Agent>

Concerning the silver iodide complex-forming agent according to the present invention, at least one of a nitrogen atom and a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion, and the silver complex forming agent. As a general guide, it is possible to obtain a large stability constant by a chelate effect from intramolecular chelate ring formation, by means of increasing the acid-base dissociation constant and the like.

In the present invention, the ultra violet-visible light absorption spectrum of the photosensitive silver halide can be measured by a transmission method or a reflection method. When the absorption derived from other compounds added to the photothermographic material overlaps with the absorption of photosensitive silver halide, the ultra violet-visible light absorption spectrum of photosensitive silver halide can be observed by using, independently or in combination, the means of difference spectrum or removal of other compounds by solvent, or the like.

As a silver iodide complex-forming agent according to the present invention, a 5 to 7-membered heterocyclic compound containing at least one nitrogen atom is preferable. In the case where the compound does not have a mercapto group, a sulfide group, or a thione group as a substituent, the said nitrogen containing 5 to 7-membered heterocycle may be saturated or unsaturated, and may have another substituent. The substituent on a heterocycle may bind to each other to form a ring.

As preferable examples of 5 to 7-membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like can be described.

More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phtharazine, triazine, 1,8-naphthylizine, 1,10-phenanthroline, and the like can be described.

These rings may have a substituent and any substituent can be used as far as it does not negatively impact the photographic property. As preferable examples, a halogen atom (fluorine atom, chlorine atom, bromine atom, or iodine atom), an alkyl group (a straight, a branched, a cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group.

Herein, two electron-attracting groups may bond to each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $—SO_3^-$, $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, naththilizine, or phenanthroline derivative, the acid dissociation constant (pKa) of a conjugated acid of nitrogen containing heterocyclic part in acid dissociation equilibrium of the said compound is preferably from 3 to 8 in the mixture solution of tetrahydrofuran/water (3/2) at 25° C., and more preferably, the pKa is from 4 to 7.

As the heterocyclic compound, pyridine, pyridazine, and a phthalazine derivative are preferable, and particularly preferable are pyridine and a phthalazine derivative.

In the case where these heterocyclic compounds have a mercapto group, a sulfide group, or a thione group as the substituent, pyridine, thiazole, isothiazole, oxazole, isoxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable.

For example, as the said silver iodide complex-forming agent, the compound represented by the following formulae (1) or (2) can be used.

Formula (1)

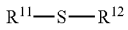

Formula (2)

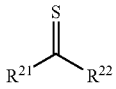

In formula (I), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7-membered nitrogen containing heterocyclic type silver iodide complex-forming agent mentioned above can be described.

Further, the compound represented by formula (3) described below can also be used preferably.

Formula (3)

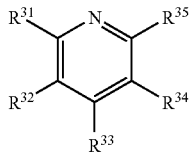

In formula (3), $R^{31}$ to $R^{35}$ each independently represent a hydrogen atom or a substituent. As the substituent represented by $R^{31}$ to $R^{35}$, the substituent of a 5 to 7-membered nitrogen containing heterocyclic type silver iodide complex-forming agent mentioned above can be used. In the case where the compound represented by formula (3) has a substituent, preferred substituting position is $R^{32}$ to $R^{34}$. $R^{31}$ to $R^{35}$ may bond to each other to form a saturated or an unsaturated ring. A preferred substituent is a halogen atom, an alkyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part is preferably from 3 to 8 in the mixed solution of tetrahydrofuran/water (3/2) at 25° C., and particularly preferably, from 4 to 7.

Furthermore, the compound represented by formula (4) is also preferable.

Formula (4)

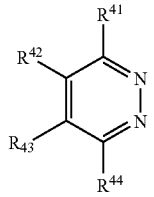

In formula (4), $R^{41}$ to $R^{44}$ each independently represent a hydrogen atom or a substituent. $R^{41}$ to $R^{44}$ may bond to each other to form a saturated or an unsaturated ring. As the substituent represented by $R^{41}$ to $R^{44}$, the substituent of a 5 to 7-membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one substituent. As examples of $R^{51}$ to $R^{56}$ in formula (5), the substituent of a 5 to 7-membered nitrogen containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group, and the like are described. An alkyl group, an alkenyl group, an aryl group, an alkoxy group, and an aryloxy group are preferable and an alkyl group, an alkoxy group, and an aryloxy group are more preferable.

Formula (5)

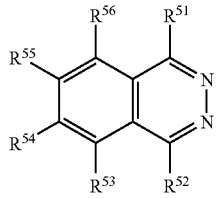

Further, the compound represented by formula (6) described below is also a preferable embodiment.

Formula (6)

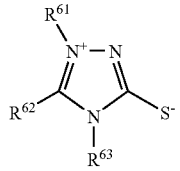

In formula (6), $R^{61}$ to $R^{63}$ each independently represent a hydrogen atom or a substituent. As examples of the substituent, the substituent of a 5 to 7-membered nitrogen containing heterocyclic type silver iodide complex-forming agent mentioned above can be described.

As the compound preferably used, the compound represented by the following formula (7) is described.

Formula (7)

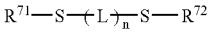

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imide group and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

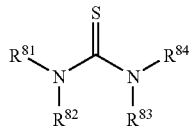

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples.

Among the silver iodide complex-forming agents described above, the compounds represented by formulae (3), (4), (5), (6), or (7) are more preferable and, the compounds represented by formulae (3) or (5) are particularly preferable.

Preferable examples of silver iodide complex-forming agent are described below, however the present invention is not limited in these.

(1)

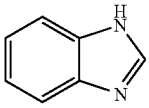

(2)

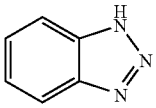

(3)

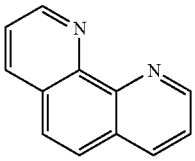

(4)

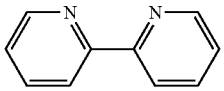

(5)

$C_5H_{11}SC_5H_{11}$ (6)

$C_4H_9SCH_2CH_2SC_4H_9$ (7)

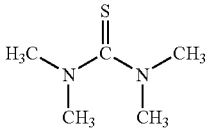

(8)

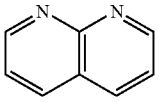

(9)

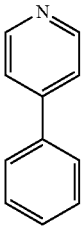

-continued (10)

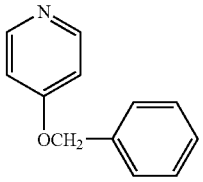

(11)

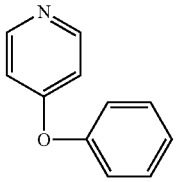

(12)

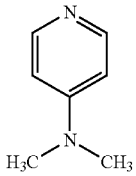

(13)

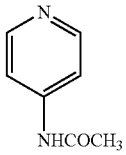

(14)

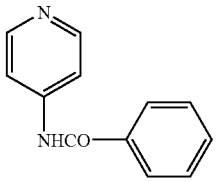

(15)

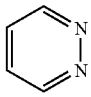

(16)

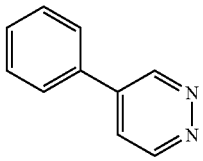

(17)

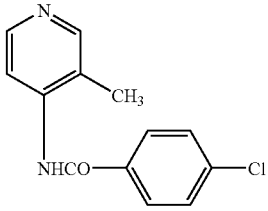

(18)

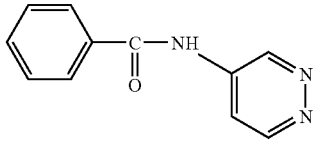

-continued
(19)
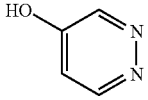
(20)
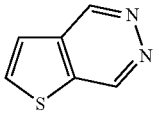
(21)
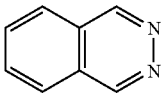
(22)
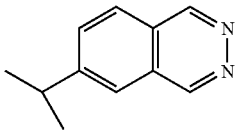
(23)
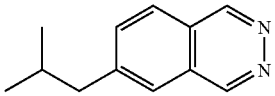
(24)
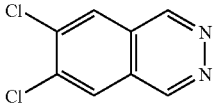
(25)
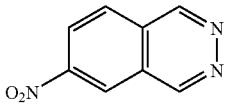
(26)
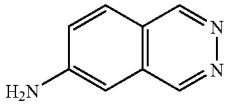
(27)
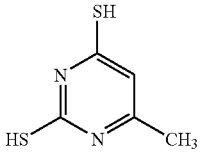
(28)
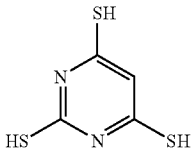
(29)
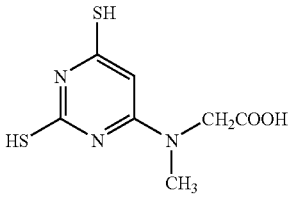
-continued
(30)
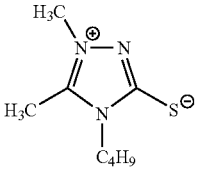
(31)
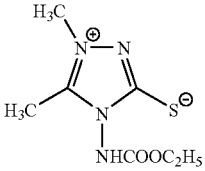
(32)
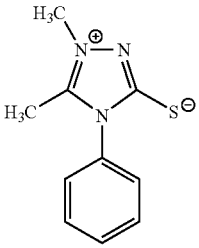
(33)
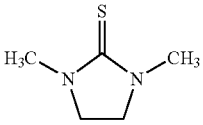
(34)
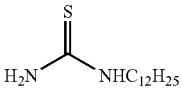
(35)
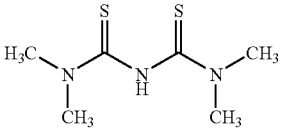
(36)
$HO(CH_2)_3S(CH_2)_2S(CH_2)_3OH$
(37)
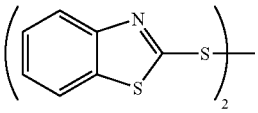
(38)
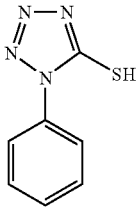
(39)
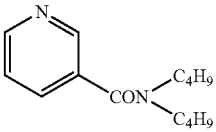

-continued (40)

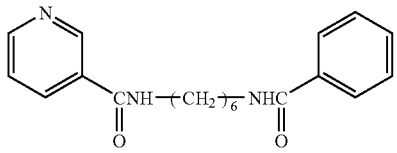

(41)

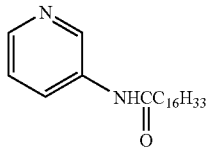

(42)

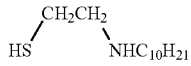

The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state or the like. It is also preferably added to the layer adjacent to the image forming layer.

Concerning the silver iodide complex-forming agent according to the present invention, a melting point of the compound is preferably adjusted to a suitable range so that it can be dissolved when heated at thermal developing temperature.

In the present invention, the absorption intensity of ultra violet-visible light absorption after thermal development is preferably decreased to 80% or less of that before thermal development. More preferably, it is decreased to 40% or less of that before thermal development, and particularly preferably 10% or less.

The silver iodide complex-forming agent according to the invention may be incorporated into a photothermographic material by being added into the coating solution, such as in the form of a solution, an emulsified dispersion, a solid fine particle dispersion, or the like.

Well known emulsified dispersing methods include a method comprising dissolving the silver iodide complex-forming agent in an oil such as dibutylphthalate, tricresylphosphate, glyceryl triacetate, diethylphthalate, or the like, using an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion.

In this case, there may also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Depending on the dispersing conditions, the amount of Zr or the like incorporated in the dispersion is generally in a range of from 1 ppm to 1000 ppm. It is practically acceptable as far as Zr is incorporated in the photothermographic material in an amount of 0.5 mg or less per 1 g of silver.

Preferably, an antiseptic (for instance, benzisothiazolinone sodium salt) is added in an aqueous dispersion.

The silver iodide complex-forming agent according to the invention is preferably used in the form of a solid dispersion.

The silver iodide complex-forming agent according to the invention is preferably used in a range of from 1 mol % to 5000 mol %, more preferably, from 10 mol % to 1000 mol % and, even more preferably, from 50 mol % to 300 mol %, with respect to the photosensitive silver halide in each case.

11) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, most preferably, from 0.07 $g/m^2$ to 0.3 $g/m^2$. The photosensitive silver halide is used in a range of from 0.01 mol to 0.5 mol, preferably, from 0.02 mol to 0.3 mol, and even more preferably from 0.03 mol to 0.2 mol, per 1 mol of the organic silver salt.

13) Mixing Photosensitive Silver Halide and Organic Silver Salt

The method of mixing separately prepared the photosensitive silver halide and the organic silver salt can include a method of mixing prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

Further, a method of mixing two or more kinds of aqueous dispersions of organic silver salts and two or more kinds of aqueous dispersions of photosensitive silver salts upon mixing is used preferably for controlling the photographic properties.

14) Mixing Silver Halide Into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, U.S. Pat. No. 6,083,681, and EP No. 1048975.

1) Organic Polyhalogen Compound

Preferable organic polyhalogen compound that can be used in the invention is explained specifically below. In the invention, preferred organic polyhalogen compound is the compound expressed by the following formula (H).

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(═O)N(R)—. And, in the case where Q is an aryl group or a heterocyclic group, Y is preferably —$SO_2$—.

In formula (H), the form where the residues, which are obtained by removing a hydrogen atom from the compound, bind to each other (generally called bis type, tris type, or tetrakis type) is also preferably used.

In formula (H), the form having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonio group, a pyridinium group, or the like), a polyethyleneoxy group, a hydroxy group, or the like is also preferable.

Specific examples of the compound expressed by formula (H) of the invention are shown below.

H-1

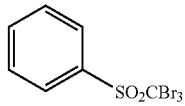

H-2

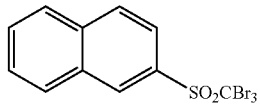

H-3

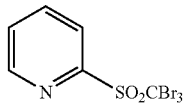

H-4

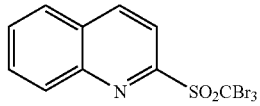

H-5

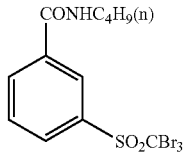

H-6

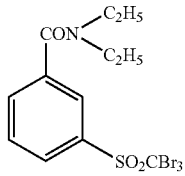

H-7

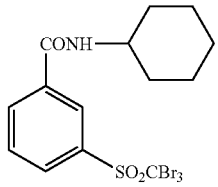

H-8

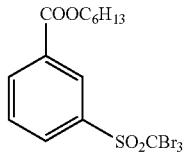

-continued

H-9

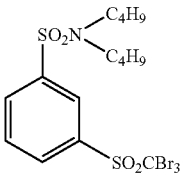

H-10

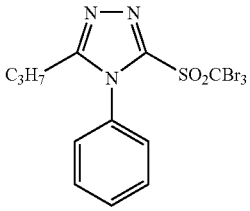

H-11

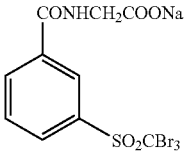

H-12

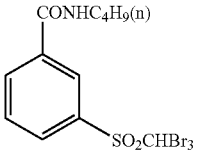

H-13

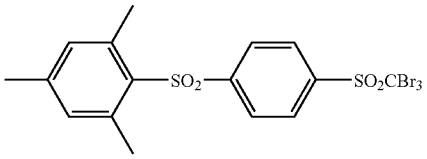

H-14

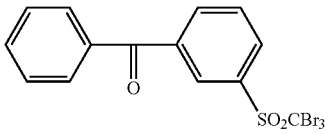

H-15

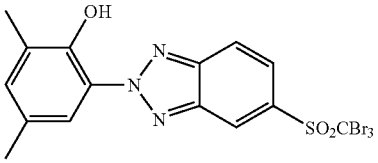

H-16

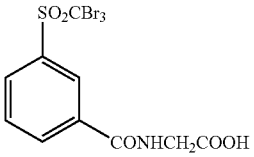

H-17

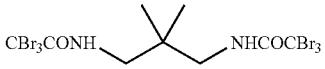

H-18

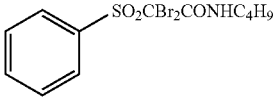

-continued

H-19

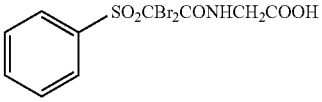

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compound expressed by formula (H) of the invention is preferably used in an amount of from $10^{-4}$ mol to 1 mol, more preferably, from $10^{-3}$ mol to 0.5 mol, and further preferably, from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in JP-B No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, or the like, may be used.

Furthermore, it may be added as a solution having mixed therein other additives such as sensitizing agents, reducing agents, toners, and the like.

In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides and Thiones

In the present invention, mercapto compounds, disulfide compounds, and thione compounds can be added in order to control the development by suppressing or enhancing development, to improve spectral sensitization efficiency, and to improve storage properties before and after development. Descriptions can be found in paragraph numbers 0067 to 0069 of JP-A No. 10-62899, a compound expressed by formula (I) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, the addition of a toner is preferred. The description of the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl) phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well-known plasticizer and lubricant can be used to improve physical properties of film. Particularly, to improve handling facility during manufacturing process or resistance to scratch during thermal development, it is preferred to use a lubricant such as a liquid paraffin, a long chain fatty acid, an amide of a fatty acid, an ester of a fatty acid, or the like. Particularly preferred are a liquid paraffin obtained by removing components having low boiling point and an ester of a fatty acid having a branch structure and a molecular weight of 1000 or more.

Concerning plasticizers and lubricants usable in the image forming layer and in the non-photosensitive layer, compounds described in paragraph No. 0117 of JP-A No. 11-65021 and in JP-A Nos. 2000-5137, 2004-219794, 2004-219802, and 2004-334077 are preferable.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Constituent Components)

1) Layer Constitution

The photothermographic material of the present invention comprises, on at least one side of a support, an image forming layer and a non-photosensitive layer, which are disposed in the order from the support side. Preferably, the material comprises an intermediate layer between them. Furthermore any other additional layer can be disposed. Each of the layer may be constituted of plural layers. For preferred example, the non-photosensitive intermediate layer may be constituted of an intermediate layer A adjacent to the image forming layer and an intermediate layer B adjacent to the said non-photosensitive layer. A back layer or a back surface protective layer may be disposed on the other side of the support.

The aforementioned non-photosensitive layer composes the outermost layer. Because the outermost layer forms an outermost surface on the image forming layer side of a photothermographic material, the task of the outermost layer is usually to prevent adhesion with other surfaces or parts and to prevent scratch defects on an image so as to improve transportability and to protect the surfaces of the photothermographic materials. Thereby, besides the binder, the outermost layer preferably contains various additives such as a matting agent, a lubricant, a surfactant, or the like.

2) Non-photosensitive Intermediate Layer

The non-photosensitive intermediate layer is disposed between the image forming layer and the outermost layer and contains a polymer latex in an amount of 50% by weight or more of binder. Besides the binder, the non-photosensitive intermediate layer may contain various additives such as a development accelerator, a development retarding agent, a dye, a pigment, a plasticizer, a lubricant, a crosslinking agent, or a surfactant, described below.

<Binder>

A preferred polymer latex is a polymer latex which contains a monomer component represented by formula (M) within a range of from 10% by weight to 70% by weight.

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, an alkyl groups having 1 to 6 carbon atoms, a halogen atom, or a cyano group. More preferably, both of $R^{01}$ and $R^{02}$ represent a hydrogen atom, or one of $R^{01}$ or $R^{02}$ represents a hydrogen atom and the other represents a methyl group.

As an alkyl group for $R^{01}$ or $R^{02}$, an alkyl group having 1 to 4 carbon atoms is preferred, and more preferred is an alkyl group having 1 to 2 carbon atoms. As a halogen atom for $R^{01}$ or $R^{02}$, a fluorine atom, a chlorine atom, and a bromine atom are preferred, and more preferred is a chlorine atom.

Preferably, both of $R^{01}$ and $R^{02}$ represent a hydrogen atom, or one of $R^{01}$ or $R^{02}$ represents a hydrogen atom and the other represents a methyl group or a chlorine atom. More preferably, both of $R^{01}$ and $R^{02}$ represent a hydrogen atom, or one of $R^{01}$ or $R^{02}$ represents a hydrogen atom and the other represents a methyl group.

Specific examples of the monomer represented by formula (M) of the present invention include 2-ethyl-1,3-butadiene, 2-n-propyl-1,3-butadiene, 2,3-dimethyl-1,3-butadiene, 2-methyl-1,3-butadiene, 2-chloro-1,3-butadiene, 1-bromo-1,3-butadiene, 2-fluoro-1,3-butadiene, 2,3-dichloro-1,3-butadiene, and 2-cyano-1,3-butadiene.

The copolymerization ratio of the monomer represented by formula (M) according to the present invention is in a range of from 10% by weight to 70% by weight, preferably from 15% by weight to 65% by weight, and more preferably from 20% by weight to 60% by weight. When the copolymerization ratio of the monomer represented by formula (M) is lower than 10% by weight, a bonding component of the binder is decreased and manufacturing-related brittleness is deteriorated.

When the copolymerization ratio of the monomer represented by formula (M) exceeds 70% by weight, the bonding component of the binder is increased, mobility of the binder is increased, and as a result, image storability is deteriorated.

In addition to the above components, the polymer of the present invention is preferably copolymerized with a monomer having an acid group. As the acid group, preferred are carboxylic acid, sulfonic acid, and phosphoric acid, and particularly preferred is carboxylic acid. The copolymerization ratio of a monomer having the acid group is preferably in a range of from 1% by weight to 20% by weight, and more preferably from 1% by weight to 10% by weight. Examples of a monomer having the acid group include acrylic acid, methacrylic acid, itaconic acid, p-styrene sulfonic acid sodium salt, isopyrene sulfonic acid, phoshoryl ethyl methacrylate, and the like. Preferred are acrylic acid and methacrylic acid, and particularly preferred is acrylic acid.

The binder of the present invention preferably has a grass transition temperature (Tg) in a range of from −30° C. to 70° C., more preferably, in a range of from −10° C. to 50° C., and even more preferably in a range of from 0° C. to 40° C., considering film-forming properties and image storability. Two or more kinds of polymers can be blended for the binder, and in this case, the blended polymer has a weighed averaged Tg which preferably falls within the range above, considering composition components. When the polymers exhibit phase separation or has a core-shell structure, a weighed averaged Tg preferably falls within the range above.

In the specification, Tg is calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used in the invention can be readily obtained by a solution polymerization method, a suspension polymerization method, an emulsion polymerization method, a dispersion polymerization method, an anionic polymerization method, a cationic polymerization method, or the like, however most preferable is an emulsion polymerization method by which polymer can be obtained as a latex. For example, the polymer latex is obtained by emulsion polymerization at about 30° C. to 100° C., preferably at 60° C. to 90° C., for 3 hours to 24 hours with stirring using water or a mixed solvent of water and a water-miscible organic solvent (for example, methanol, ethanol, acetone, or the like) as a dispersion medium, and using a monomer mixture in an amount of 5% by weight to 150% by weight with respect to the dispersion solvent, an emulsifying agent in an amount of 0.1% by weight to 20% by weight with respect to a total amount of monomers, and a polymerization initiator. Conditions such as the dispersion medium, monomer concentration, the amount of the initiator, the amount of the emulsifying agent, the amount of a dispersing agent, the reaction temperature and the addition method of the monomer may be appropriately determined considering the kind of the monomer used. A dispersing agent is preferably used, if necessary.

Emulsion polymerization is usually carried out according to the following documents: "Gosei Jushi Emulsion (Synthetic Resin Emulsion)" ed. by Taira Okuda and Hiroshi Inagaki, Polymer Publishing Association (1978); "Gosei Latex no Oyo (Application of Synthetic Latex)" ed. by Taka-aki Sugimura, Yasuo Kataoka, Soichi Suzuki and Keiji Kasahara, Polymer Publishing Association (1993); and "Gosei Latex no Kagaku (Chemistry of Synthetic Latex)" by Soichi Muroi, Polymer Publishing Association (1970).

Emulsion polymerization method for synthesizing the polymer latex of the invention may be selected from an overall polymerization method, a monomer addition (continuous or divided) method, an emulsion addition method and a seed polymerization method. The overall polymerization method, monomer addition (continuous or divided)

method, and emulsion addition method are preferable in view of productivity of the latex.

The polymerization initiator described above may have a radical generation ability, and examples of them available include inorganic peroxides such as persulfate salts and hydrogen peroxide, peroxides described in the catalogue of organic peroxides by Nippon Oil and Fat Co., and azo compounds described in azo polymerization initiator catalogue by Wako Pure Chemical Industries, Ltd. Among them, water-soluble peroxides such as persulfate, and water-soluble azo compounds described in azo polymerization initiator catalogue by Wako Pure Chemical Industries, Ltd., are preferable. Ammonium persulfate, sodium persulfate, potassium persulfate, azobis(2-methylpropionamidine) hydrochloride, azobis(2-methyl-N-(2-hydroxyethyl)propionamide and azobiscyanovaleric acid are more preferable, and particularly, peroxides such as ammonium persulfate, sodium persulfate and potassium persulfate are preferable from the viewpoint of image storability, solubility, and cost.

The addition amount of the polymerization initiator described above is preferably in a range of from 0.3% by weight to 2.0% by weight, more preferably from 0.4% by weight to 1.75% by weight, and particularly preferably from 0.5% by weight to 1.5% by weight, based on a total amount of monomers. Image storability decreases when the amount of the polymerization initiator is less than 0.3% by weight, while the latex tends to be aggregated to deteriorate coating ability when the amount of the polymerization initiator exceeds 2.0% by weight.

As the polymerization emulsifying agent mentioned above, any surfactants such as an anionic surfactant, a nonionic surfactant, a cationic surfactant, or an amphoteric surfactant can be employed. An anionic surfactant is preferably employed from the viewpoint of dispersibility and image storability, and more preferred is a sulfonic acid-type anionic surfactant which maintains the polymerization stability even in a small amount and has a hydrolysis resistance. Preferred is a long chain alkyl diphenylether disulfonate such as "PELEX SS-H" (trade name, available from Kao Co., Ltd.), and particularly preferred is a low electrolyte-type surfactant such as "PIONIN A-43-S" (trade name, available from Takemoto Oil & Fat Co., Ltd.).

As the polymerization emulsifying agent mentioned above, a sulfonic acid-type surfactant is preferably used in a range of from 0.1% by weight to 10.0% by weight, based on a total amount of monomers, more preferably from 0.2% by weight to 7.5% by weight, and particularly preferably from 0.3% by weight to 5.0% by weight. Stability in the emulsion polymerization process can not secure when the addition amount of the polymerization emulsifying agent is less than 0.1% by weight, while image storability decreases when the addition amount exceeds 10.0% by weight.

Chelating agents are preferably used for the synthesis of the polymer latex used in the invention. The chelating agent is a compound capable of coordinating multi-valent metal ions such as iron ion, and alkali earth metal ions such as calcium ion, and examples thereof include the compounds described in JP-B No. 6-8956; U.S. Pat. No. 5,053,322; and JP-A Nos. 4-73645, 4-127145, 4-247073, 4-305572, 6-11805, 5-173312, 5-66527, 5-158195, 6-118580, 6-110168, 6-161054, 6-175299, 6-214352, 7-114161, 7-114154, 7-120894, 7-199433, 7-306504, 9-43792, 8-314090, 10-182571, 10-182570, and 11-190892.

The chelating agent used in the invention is preferably an inorganic chelating compound (sodium tripolyphosphate, sodium hexametaphosphate, sodium tetrapolyphosphate, or the like), an aminopolycarboxylic acid chelating compound (nitrilotriacetic acid, ethylenediamine tetraacetic acid, or the like), an organic phosphonic acid chelating agent (compounds described in Research Disclosure No. 18170, JP-A Nos. 52-102726; 53-42730, 56-97347, 54-121127, 55-4024, 55-4025, 55-29883, 55-126241, 55-65955, 55-65956, 57-179843, and 54-61125; and West Germany Patent (WGP) No. 1045373), a polyphenol chelating agent, or a polyamine chelating agent. An aminopolycarboxylic acid derivative is particularly preferable.

Preferable examples of the aminopolycarboxylic acid derivative are described in the supplement table of "EDTA (-Chemistry of Complexane-)", Nankodo, 1977. A part of the carboxyl group of these compounds may be substituted by a salt of alkali metal such as sodium or potassium, or an ammonium salt. Particularly preferable aminocarboxylic acid derivatives include iminodiacetic acid, N-methyliminodiacetic acid, N-(2-aminoethyl)iminodiacetic acid, N-(carbamoylethyl)iminodiacetic acid, nitrilotriacetic acid, ehylenediamine-N,N'-diacetic acid, ehylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cic-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2-oxy-bis (ethyliminodiacetic acid), 2,2'-ethylenedioxy-bis (ethyliminodiacetic acid), ethylenediamine-N,N'-diacetic acid-N,N'-di-β-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N"',N"'-hexaacetic acid, and 1,2,3-triaminopropane-N,N,N',N",N"',N"'-hexaacetic acid. A part of the carboxylic group of these compounds may be substituted by a salt of alkali metal such as sodium or potassium, or an ammonium salt.

The addition amount of the chelating agent described above is preferable from 0.01% by weight to 0.4% by weight, more preferably from 0.02% by weight to 0.3% by weight, and particularly preferably from 0.03% by weight to 0.15% by weight, based on a total amount of monomers. When the amount of the chelating agent is less than 0.01% by weight, metal ions contaminated in the production process of the polymer latex are insufficiently trapped to decrease stability of the latex against aggregation to deteriorate coating ability. When the amount exceeds 0.4% by weight, the viscosity of the latex increases to deteriorate coating ability.

The chain transfer agent is preferably used in the synthesis of the polymer latex used in the invention. A gelling ratio can be controlled by the addition of the chain transfer agent. The compounds described in Polymer Handbook Third Edition (Wiley-Interscience, 1989) are preferable as the chain transfer agents. Sulfur compounds are preferable since they have high chain transfer ability to make the amount of use of the reagent small. Particularly preferable chain reaction agents are hydrophobic mercaptan chain transfer agents such as tert-dodecylmercaptan, n-dodecylmercaptan, or the like.

The amount of the chain transfer agent described above is preferably from 0.2% by weight to 2.0% by weight, more preferably from 0.3% by weight to 1.8% by weight, and particularly preferably from 0.4% by weight to 1.6% by weight, based on a total amount of monomers.

In the emulsion polymerization, additives such as an electrolyte, a stabilizer, a viscosity increasing agent, an antifoaming agent, an antioxidant, a vulcanizing agent, an antifreeze agent, a gelling agent, a vulcanization accelerator, or the like described in Synthetic Rubber Handbook and the like may be used in addition to the compounds above.

<Specific Examples of Polymer>

Specific examples of the polymer used in the present invention are listed below, however the invention is not restricted to these. x, y, z, and z' in chemical formula show the mass ratios in the polymer composition, and the sum of x, y, z, and z' is equal to 100%. Tg represents the glass transition temperature of a dry film obtained from the polymer.

P-1

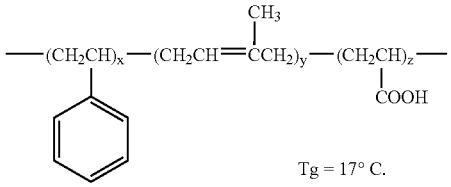

Tg = 17° C.

x = 61.5
y = 35.5
z= 3

P-2

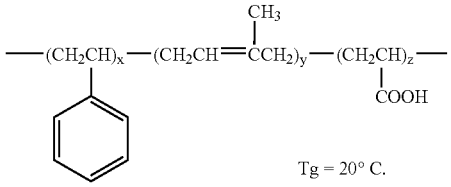

Tg = 20° C.

x = 63
y = 34
z = 3

P-3

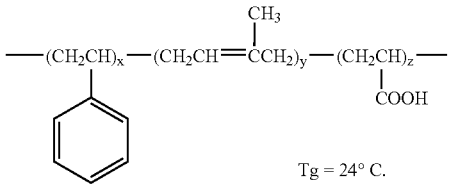

Tg = 24° C.

x = 65
y = 32
z = 3

P-4

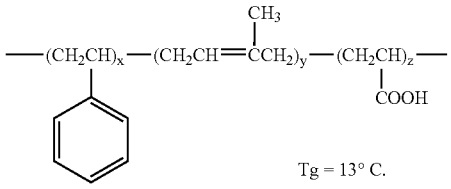

Tg = 13° C.

x = 59.5
y = 37.5
z = 3

P-5

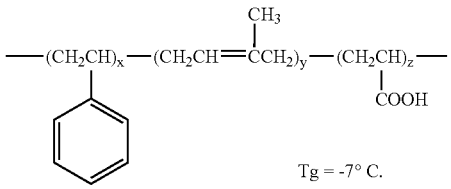

Tg = -7° C.

x = 45
y = 50
z = 5

P-6

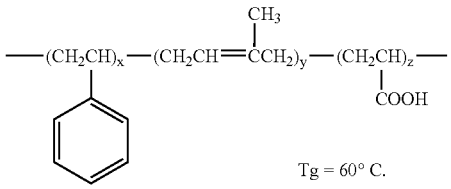

Tg = 60° C.

x = 79
y = 15
z = 6

-continued
P-7
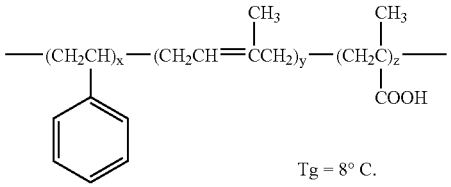
x = 55
y = 41
z = 4
Tg = 8° C.
P-8
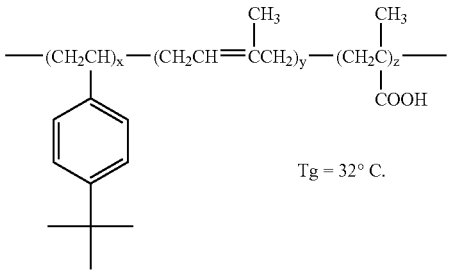
x = 60
y = 35
z = 5
Tg = 32° C.
P-9
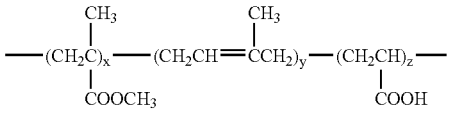
x = 62
y = 33
z = 5
Tg = 24° C.
P-10
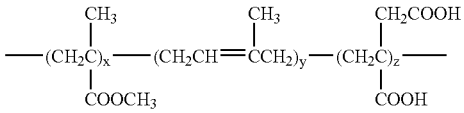
x = 63
y = 33
z = 4
Tg = 28° C.
P-11
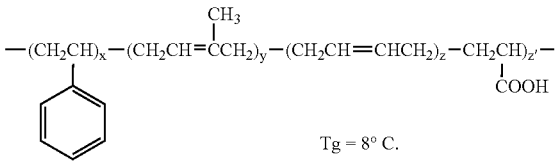
x = 57
y = 35
z = 5
z' = 3
Tg = 8° C.
P-12
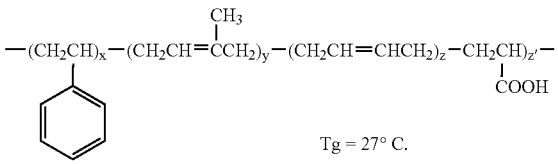
x = 67
y = 28
z = 2
z' = 3
Tg = 27° C.
P-13
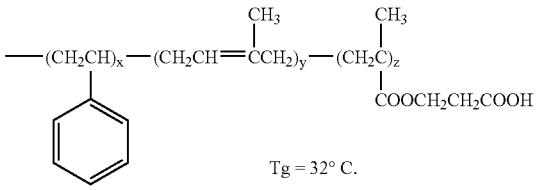
x = 70
y = 20
z = 15
Tg = 32° C.

-continued
P-14
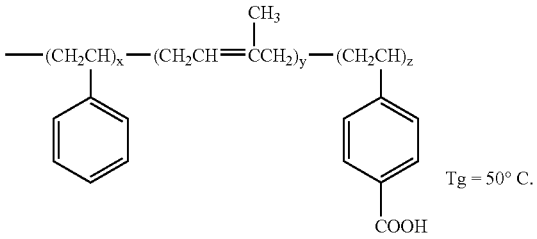
x = 65
y = 20
z = 15
Tg = 50° C.
P-15
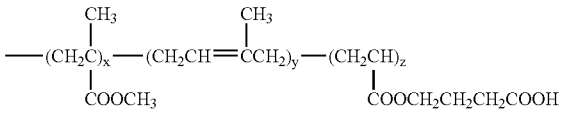
x = 50
y = 38
z = 12
Tg = 3° C.
P-16
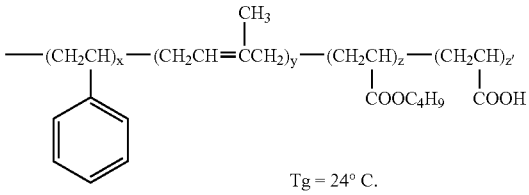
x = 60
y = 10
z = 25
z' = 5
Tg = 24° C.
P-17
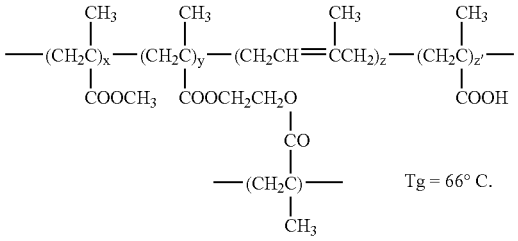
x = 79
y = 2
z = 15
z' = 4
Tg = 66° C.
P-18
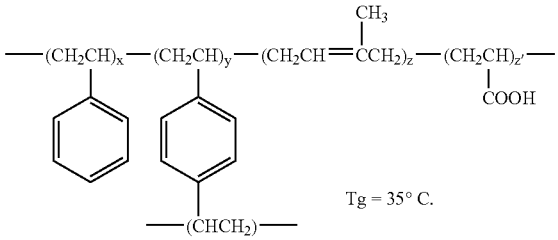
x = 66
y = 2
z = 29
z' = 3
Tg = 35° C.
P-19
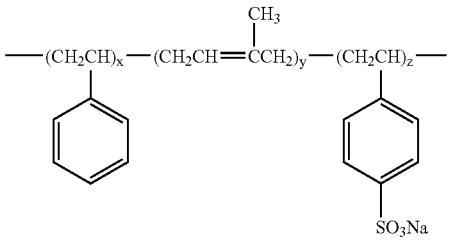
x = 63
y = 35
z = 2
Tg = 18° C.

-continued
P-20
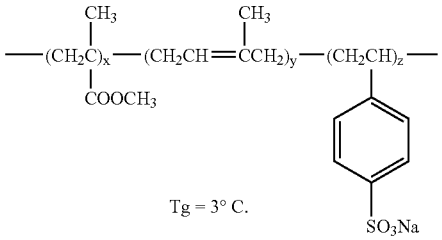
x = 51
y = 45
z = 4
Tg = 3° C.
P-21
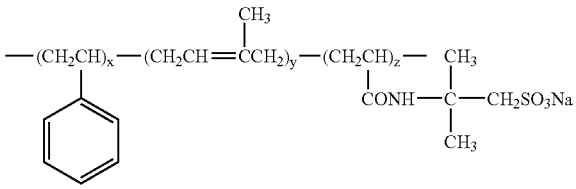
x = 29
y = 70
z = 1
Tg = -30° C.
P-22
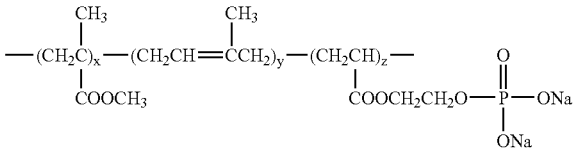
x = 43
y = 54
z = 3
Tg = -12° C.
P-23
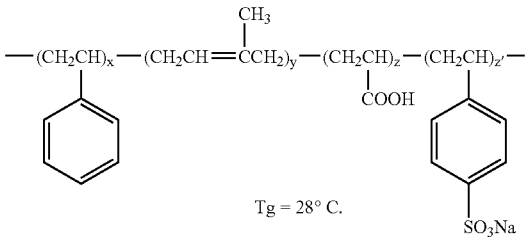
x = 67
y = 30
z = 1
z' = 2
Tg = 28° C.
P-24
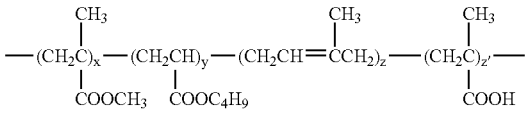
x = 70
y = 22
z = 5
z' = 3
Tg = 42° C.
P-25
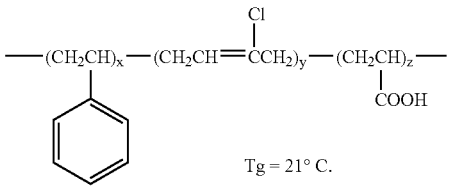
x = 55
y = 42
z = 3
Tg = 21° C.
P-26
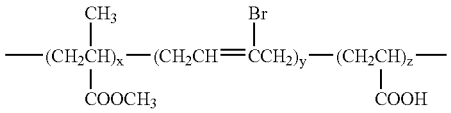
x = 49
y = 58
z = 3
Tg = -10° C.

-continued
P-27
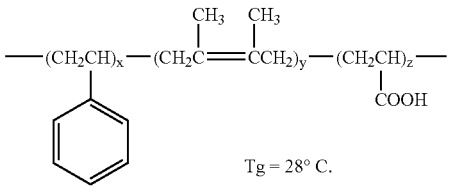
x = 40
y = 57
z = 3
Tg = 28° C.
P-28
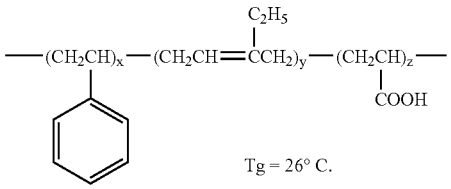
x = 68
y = 28
z = 4
Tg = 26° C.
P-29
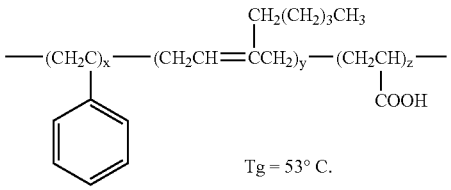
x = 80
y = 15
z = 5
Tg = 53° C.
P-31
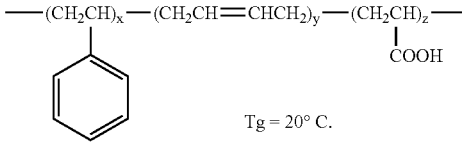
x = 69
y = 28
z = 3
Tg = 20° C.
P-32
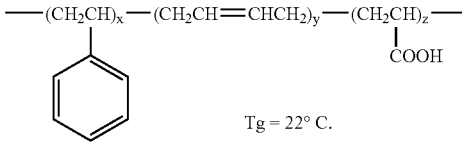
x = 70
y = 27
z = 3
Tg = 22° C.
P-33
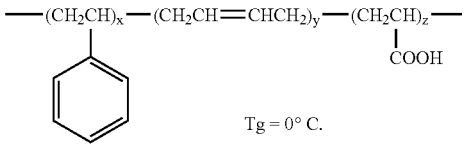
x = 60
y = 37
z = 3
Tg = 0° C.
P-34
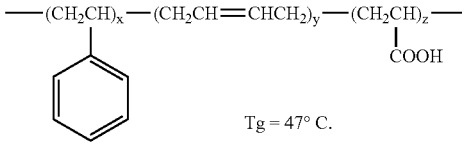
x = 80
y = 17
z = 3
Tg = 47° C.
P-35
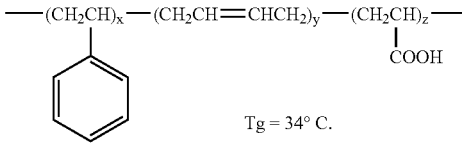
x = 75
y = 22
z = 3
Tg = 34° C.

-continued
P-36
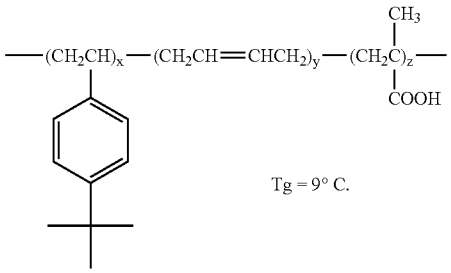
x = 60
y = 37
z = 3
Tg = 9° C.
P-37
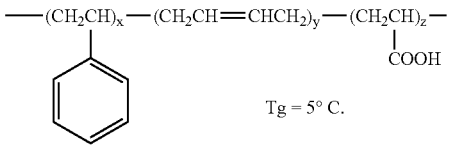
x = 62
y = 35
z = 3
Tg = 5° C.
P-38
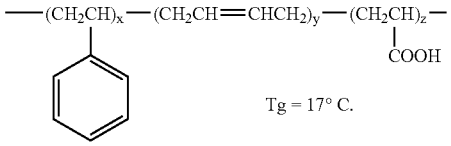
x = 68
y = 29
z = 3
Tg = 17° C.
P-39
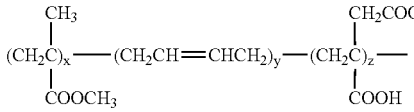
x = 62
y = 34
z = 4
Tg = 8° C.
P-40
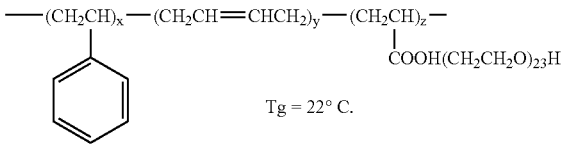
x = 70
y = 15
z = 15
Tg = 22° C.
P-41
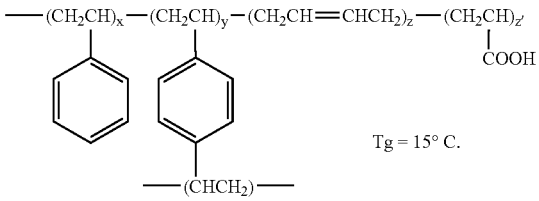
x = 65
y = 2
z = 30
z' = 3
Tg = 15° C.
P-42
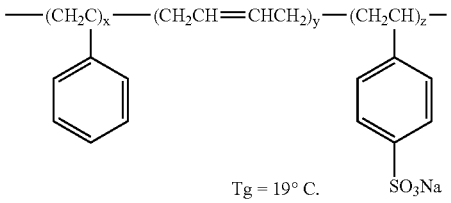
x = 70
y = 27
z = 3
Tg = 19° C.
P-43
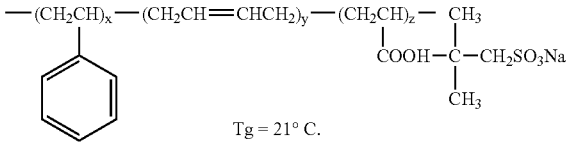
x = 68
y = 29
z = 3
Tg = 21° C.

-continued

P-44

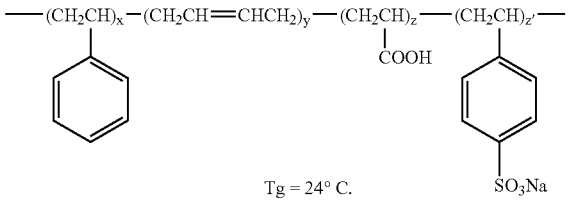

x = 70
y = 27
z = 1
z' = 2

Tg = 24° C.

P-45

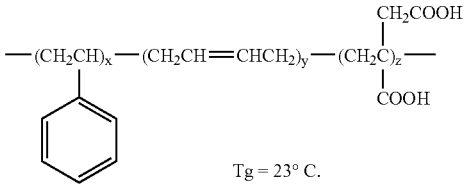

x = 70
y = 27
z = 3

Tg = 23° C.

P-46

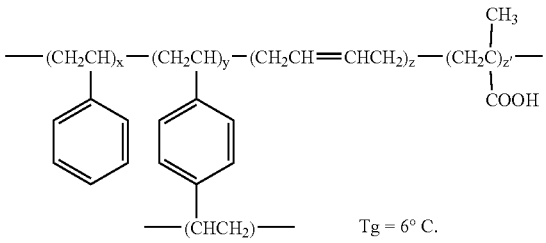

x = 60
y = 3
z = 35
z' = 2

Tg = 6° C.

As examples of commercially available latex of styrene-butadiene copolymer preferably used in the present invention, there can be mentioned LACSTAR 3307B and 7132C (all manufactured by Dainippon Ink and Chemicals, Inc.), Nipol Lx 416 (manufactured by Nippon Zeon Co., Ltd.), and the like.

The polymer latex above may be used alone, or may be used by blending two or more kinds depending on needs.

In the invention, for the solvent of a coating solution for the polymer latex, water solvent can be used and any of water-miscible organic solvents may be used in combination. As a water-miscible organic solvent, there can be described, for example, alcohols such as methyl alcohol, ethyl alcohol, propyl alcohol, or the like; cellosolves such as methyl cellosolve, ethyl cellosolve, butyl cellosolve, or the like; ethyl acetate, dimethylformamide, and the like. The addition amount of the organic solvent is preferably 50% by weight or less, and more preferably 30% by weight or less, with respect to the solvent.

As for the polymer latex of the invention, the concentration of the polymer is preferably from 10% by weight to 70% by weight, more preferably from 20% by weight to 60% by weight, and particularly preferably from 30% by weight to 55% by weight, with respect to the latex liquid in each case.

The equilibrium water content under 25° C. and 60% RH is preferably 2% by weight or lower, but is more preferably, in a range of from 0.01% by weight to 1.5% by weight, and is even more preferably, from 0.02% by weight to 1.0% by weight.

The average particle diameter of the latex particles according to the invention is in a range of from 1 nm to 50,000 nm, preferably from 5 nm to 1,000 nm, more preferably from 10 nm to 500 nm, and even more preferably from 50 nm to 200 nm. There is no particular limitation concerning a particle diameter distribution, and they may be widely distributed or may exhibit a monodisperse particle diameter distribution. From the viewpoint of controlling physical properties of the coating solution, preferred mode of usage includes mixing two or more types of particles each having monodisperse particle diameter distribution.

In the non-photosensitive intermediate layer of the present invention, if necessary, there can be added hydrophilic polymers such as gelatin, poly(vinyl alcohol), methyl cellulose, hydroxypropyl cellulose, carboxymethyl cellulose, or the like. The hydrophilic polymers above are preferably added in an amount of 50% by weight or less, and more preferably 20% by weight or less, with respect to a total weight of the binder incorporated in the non-photosensitive intermediate layer.

The total amount of binder in the non-photosensitive intermediate layer according to the invention is preferably in a range of from 0.5 g/m$^2$ to 3.0 g/m$^2$, and more preferably from 1.0 g/m$^2$ to 2.0 g/m$^2$.

3) Non-photosensitive Intermediate Layer B

In the present invention, a non-photosensitive intermediate layer B may be disposed between the above-described non-photosensitive intermediate layer and the outermost layer. The non-photosensitive intermediate layer B according to the invention preferably contains a hydrophilic polymer in an amount of 50% by weight or more, and more preferably, 60% by weight or more, as binder.

In the present invention, the hydrophilic polymer is preferably a hydrophilic polymer derived from animal protein. The hydrophilic polymer derived from animal protein means natural or chemically modified water-soluble polymer such as glue, casein, gelatin, egg white, or the like. It is preferably gelatin, in which are acid-processed gelatin and alkali-processed gelatin (lime-processed gelatin or the like) depending on a synthetic method and any of them can be preferably used. A molecular weight of gelatin used is preferably from 10,000 to 1,000,000. Modified gelatin, which is obtained by modifying a gelatin utilizing an amino group or a carboxy group of gelatin (e.g., phthalated gelatin or the like), can be also used. As gelatin, there can be used an inert gelatin (e.g., Nitta gelatin 750), a phthalated gelatin (e.g., Nitta gelatin 801), and the like.

In an aqueous gelatin solution, solation occurs when gelatin is heated to 30° C. or higher, and gelation occurs and the solution loses fluidity when it is cooled to lower than 30° C. As this sol-gel exchange occurs reversibly, an aqueous gelatin solution as a coating solution has a setting ability. That means, gelatin solution loses fluidity when it is cooled to lower than 30° C.

Further, the hydrophilic polymer derived from animal protein can be used in combination with the following hydrophilic polymer which is not derived from animal protein and/or a hydrophobic polymer.

A crosslinking agent, a surfactant, a pH control agent, an antiseptic, a rust-preventing agent, a dye, a pigment, a color-tone-adjusting agent, or the like can be added in the non-photosensitive intermediate layer B.

The hydrophilic polymer which is not derived from animal protein according to the present invention means a natural polymer (polysaccharide series, microorganism series, or animal series) other than animal protein such as gelatin or the like, a semi-synthetic polymer (cellulose series, starch series, or alginic acid series), and a synthetic polymer (vinyl series or others) and corresponds to synthetic polymer such as poly(vinyl alcohol) described below and natural or semi-synthetic polymer made by cellulose or the like derived from plant as a raw material. Poly(vinyl alcohols) and acrylic acid-vinyl alcohol copolymers are preferable.

The hydrophilic polymer which is not derived from animal protein has no setting ability, but when it is used in combination with the gelling agent, this has a setting ability and thus, coating ability becomes preferable.

As the hydrophobic polymer, a polymer which is dispersible to an aqueous solvent is preferred.

Suitable as the polymer which is dispersible to an aqueous solvent are those that are synthetic resin or polymer and their copolymer; or media forming a film; for example, included are cellulose acetates, cellulose acetate butyrates, poly(methyl methacrylates), poly(vinyl chlorides), poly(methacrylic acids), styrene-maleic anhydride copolymers, styrene-acrylonitrile copolymers, styrene-butadiene copolymers, poly(vinyl acetals) (for example, poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides.

Specifically, latexes which can be used in the non-photosensitive intermediate layer of the present invention, and latexes of polyacrylate, polyurethane, polymethacrylate, or copolymers thereof, and the like can be described.

4) Auxiliary Additives

The intermediate layer and the outermost layer according to the present invention can contain various kinds of auxiliary additives other than the binder depending on purpose.

<Gelling Agent>

The gelling agent according to the present invention is a compound which can gelate when it is added into an aqueous solution of the water-soluble polymer which is not derived from animal protein or an aqueous latex solution of the hydrophobic polymer and cooled, or a compound which can gelate when it is further used with the galation accelerator. The fluidity is remarkably decreased by the occurrence of gelation.

The following water-soluble polysaccharides can be described as the specific examples of the gelling agent. Namely these are at least one kind selected from the group consisting of agar, κ-carrageenan, ι-carrageenan, alginic acid, alginate, agarose, furcellaran, jellan gum, glucono-δ-lactone, azotobactor vinelandii gum, xanthan gum, pectin, guar gum, locust bean gum, tara gum, cassia gum, glucomannan, tragacanth gum karaya gum, pullulan, gum arabic, arabinogalactan, dextran, sodium carboxymethyl cellulose, methyl cellulose, cyalume seed gum, starch, chitin, chitosan, and curdlan.

As the compounds which can gelate by cooling after melted by heating, agar, carrageenan, jellan gum, and the like are included.

Among these gelling agents, κ-carrageenan (e.g., K-9F produced by DAITO Co.: K-15, 21, 22, 23, 24 and I-3 produced by NITTA GELATIN Co.), ι-carrageenan, and agar are preferable, and κ-carrageenan is particularly preferable.

The gelling agent is preferably used in a range of from 0.01% by weight to 10.0% by weight, preferably from 0.02% by weight to 5.0% by weight, and more preferably from 0.05% by weight to 2.0% by weight, with respect to the binder polymer.

<Gelling Accelerator>

The gelling agent is preferably used with a gelation accelerator. A gelation accelerator in the present invention is a compound which accelerates gelation by contact with a gelling agent, whereby the gelling function can be developed by specific combination with the gelling agent. In the present invention, the combinations of the gelling agent and the gelation accelerator such as shown below can be used.

A combination of alkali metal ions such as potassium ion or the like or alkali earth metal ions such as calcium ion, magnesium ion, or the like as the gelation accelerator and carrageenan, alginate, azotobactor vinelandii gum, pectin, sodium carboxymethyl cellulose, or the like as the gelling agent.

A combination of boric acid or other boron compounds as the gelation accelerator and guar gum, locust bean gum, tara gum, cassia gum, or the like as the gelling agent;

A combination of acids or alkali compounds as the gelation accelerator and alginate, glucomannan, pectin, chitin, chitosan, curdlan, or the like as the gelling agent;

A water-soluble polysaccharides which can form gel by reaction with the gelling agent is used as the galation accelerator. As typical examples, the combination of xanthan gum as the gelling agent and cassia gum as the gelation accelerator, and the combination of carrageenan as the gelling agent and locust bean gum as the gelation accelerator;

and the like are illustrated.

As the typical examples of the combination of these gelling agents and gelation accelerators, the following combinations a) to g) can be described.

a) Combination of κ-carrageenan and potassium;

b) combination of ι-carrageenan and calcium;

c) combination of low methoxyl pectin and potassium;

d) combination of sodium alginate and potassium;

e) combination of locust bean gum and xanthan gum;

f) combination of jellan gum and acid;

g) combination of locust bean gum and xanthan gum.

These combinations may be used simultaneously as plural combinations.

Although the gelation accelerator can be added to the same layer in which the gelling agent is added, it is preferably added in a different layer as to react. It is more preferable to add the galation accelerator to the layer not directly adjacent to the layer containing the gelling agent. Namely, it is more preferable to set a layer not containing any of the gelling agent and the gelation accelerator between the layer containing the gelling agent and the layer containing the gelation accelerator.

The gelation accelerator is used in a range of from 0.1% by weight to 200% by weight, and preferably from 1.0% by weight to 100% by weight, with respect to the gelling agent.

In the layer containing a hydrophilic polymer, other additives can be added, if necessary. As these additives, there can be described a surfactant, a pH control agent, an antiseptic, a rust-preventing agent, a dye, a pigment, a color-tone-adjusting agent, and the like.

<Auxiliary Film-forming Agent>

To control the minimum film-forming temperature of the aqueous dispersion of a hydrophobic polymer, an auxiliary film-forming agent may be added. The auxiliary film-forming agent is also called a temporally plasticizer and is the compound (usually an organic solvent) which makes a minimum film-forming temperature of polymer latex decrease and for instance, is described in the above "GOUSEI LATEX NO KAGAKU" (Soichi Muroi, published by Kobunshi Kankokai (1970)). Preferred auxiliary film-forming agents are the following compounds, but the compound usable in the present invention is not limited in the following specific examples.

Z-1: Benzyl alcohol,

Z-2: 2,2,4-trimethylpentanediol-1,3-monoisobutyrate,

Z-3: 2-dimethylaminoethanol,

Z-4: diethylene glycol.

<Crosslinking Agent>

In the present invention, a crosslinking agent is preferably added in any layer on the side having thereon an image forming layer, and more preferably a crosslinking agent is added in the layer containing a hydrophilic polymer such as the non-photosensitive intermediate layer B or the like. The addition of a crosslinking agent can produce an excellent photothermographic material having a non-photosensitive intermediate layer exhibiting a good degree of hydrophobic property and water resistance.

As the crosslinking agent, it is enough that the crosslinking agent has plural groups, which react with an amino group or a carboxy group, in a molecule, and the species of the crosslinking agent are not particularly limited. Examples of the crosslinking agent are described in T. H. James, "THE THEORY OF THE PHOTOGRAPHIC PROCESS, FOURTH EDITION" (Macmillan Publishing Co., Inc., pages 77 to 87, 1977). Both of a crosslinking agent of inorganic compound (for example, chrome alum) and a crosslinking agent of organic compound are preferred, but more preferred is a crosslinking agent of organic compound.

As the crosslinking agent for the layer containing a hydrophobic polymer such as the non-photosensitive intermediate layer or the like, it is enough that the crosslinking agent has plural groups, which react with a carboxy group, in a molecule, and the species of the crosslinking agent are not particularly limited.

As preferable organic compounds of the crosslinking agent, carboxylic acid derivatives, carbamic acid derivatives, sulfonate ester compounds, sulfonyl compounds, epoxy compounds, aziridine compounds, isocyanate compounds, carbodiimide compounds, and oxazoline compounds can be described. Epoxy compounds, isocyanate compounds, carbodiimide compounds, and oxazoline compounds are more preferred. The crosslinking agent may be used alone or two or more kinds of them may be used in combination.

Specifically, following compounds can be described, however, the present invention is not limited in following examples.

<<Carbodiimide>>

Water-soluble or water-dispersible carbodiimide compounds are preferred, and as examples, polycarbodiimide derived from isophorone diisocyanate described in JP-A No. 59-187029 and JP-B No. 5-27450, carbodiimide compounds derived from tetramethylxylylene diisocyanate described in JP-A No. 7-330849, multi-branched type carbodiimide compounds described in JP-A No. 10-30024, and carbodiimide compounds derived from dicyclohexyl methanediisocyanate described in JP-A No. 2000-7642 can be described.

<<Oxazoline Compound>>

Water-soluble or water-dispersible oxazoline compounds are preferred, and as example, oxazoline compounds described in JP-A No. 2001-215653 can be described.

<<Isocyanate Compound>>

Since it is reactable compound with water, water-dispersible isocyanate is preferred from the viewpoint of stability of its solution, and especially that having self-emulsification property is preferred. As examples, water-dispersible isocyanates described in JP-A Nos. 7-304841, 8-277315, 10-45866, 9-71720, 9-328654, 9-104814, 2000-194045, 2000-194237 and 2003-64149 can be described.

<<Epoxy Compound>>

Water-soluble or water-dispersible epoxy compounds are preferred, and as examples, water-dispersible epoxy compounds described in JP-A Nos. 6-329877 and 7-309954 can be described.

More specific examples of crosslinking agent for use in the present invention are shown below, however the present invention is not limited in the following examples.

Epoxy Compound

Trade name: Dickfine EM-60 (Dai Nippon Ink & Chemicals, Inc.)

Isocyanate Compound

Trade name: Duranate WB40-100 (Asahi Chemical Industries Co., Ltd.)

Duranate WB40-80D (Asahi Chemical Industries Co., Ltd.)

Duranate WT20-100 (Asahi Chemical Industries Co., Ltd.))

Duranate WT30-100 (Asahi Chemical Industries Co., Ltd.)

CR-60N (Dainippon Ink & Chemicals, Inc.)

Carbodiimide Compound

Trade name: Carbodilite V-02 (Nisshinbo Industries, Inc.)

Carbodilite V-02-L2 (Nisshinbo Industries, Inc.)

Carbodilite V-04 (Nisshinbo Industries, Inc.)

Carbodilite V-06 (Nisshinbo Industries, Inc.)

Carbodilite V-02 (Nisshinbo Industries, Inc.)

Carbodilite E-01 (Nisshinbo Industries, Inc.)

Carbodilite E-02 (Nisshinbo Industries, Inc.)

Oxazoline Compound

Trade name: Epocros K-1010E (Nippon Shokubai Co., Ltd.)

Epocros K-1020E (Nippon Shokubai Co., Ltd.)

Epocros K-1030E (Nippon Shokubai Co., Ltd.)

Epocros K-2010E (Nippon Shokubai Co., Ltd.)

Epocros K-2020E (Nippon Shokubai Co., Ltd.)

Epocros K-2030E (Nippon Shokubai Co., Ltd.)

Epocros WS-500 (Nippon Shokubai Co., Ltd.)

Epocros WS-700 (Nippon Shokubai Co., Ltd.)

The crosslinking agent for use in the present invention may be added by mixing it in a solution for binder in advance, or may be added at the end of the preparing process of the coating solution. Or, the crosslinking agent can be added just prior to coating.

The addition amount of the crosslinking agent for use in the present invention is preferably from 0.5 part by weight to 200 part by weight with respect to 100 part by weight of a binder in a component layer including the crosslinking agent, more preferably from 2 part by weight to 100 part by weight, and even more preferably from 3 part by weight to 50 part by weight.

<Viscosity Increasing Agent>

A viscosity increasing agent is preferably added to a coating solution for the non-photosensitive intermediate layer. By the addition of the viscosity increasing agent, a hydrophobic layer having an uniform thickness can be formed. Examples of the preferable viscosity increasing agent include alkaline metal salts of poly(vinyl alcohol), hydroxyethyl cellulose, and hydroxymethyl cellulose. In regard to the handling property, preferred are compounds having thixotropic property, and therefore, hydroxyethyl cellulose, sodium hydroxymethylcarboxylate, or carboxymethyl-hydroxyethyl cellulose is used.

Viscosity of the coating solution for non-photosensitive intermediate layer containing the viscosity increasing agent, measured at 40° C., is preferably from 1 mPa·s to 1000 mPa·s, more preferably from 10 mPa·s to 100 mPa·s, and even more preferably from 15 mPa·s to 60 mPa·s.

5) Outermost Layer

The non-photosensitive layer which composes the outermost layer on the image forming layer side of the present invention is explained below.

The outermost layer preferably contains, besides the binder, additives such as a matting agent, a lubricant, a surfactant, or the like to improve transportability and to protect the surface of the photothermographic material.

As the binder, a hydrophilic polymer or a polymer latex, or a mixture thereof are preferably used.

<Hydrophilic Polymer>

As the hydrophilic polymer, hydrophilic polymers derived from animal protein described in the paragraph of [non-photosensitive intermediate layer B] is preferably used.

<Polymer Latex>

Polymer latex used for the binder of the outermost layer of the present invention is explained.

The content of the polymer latex is preferably 50% by weight or higher, and more preferably in a range of from 50% by weight to 75% by weight.

A polymer latex having an equilibrium water content under 25° C. and 60% RH of 5% by weight or lower is preferred. The term "equilibrium water content under 25° C. and 60% RH" as referred herein can be expressed as follows:

$$\text{Equilibrium water content under 25° C. and 60\% RH} = [(W1 - W0)/W0] \times 100 (\text{\% by weight})$$

wherein, W1 is the weight of the polymer in moisture-controlled equilibrium under the atmosphere of 25° C. and 60% RH, and W0 is the absolutely dried weight at 25° C. of the polymer.

The equilibrium water content in the present invention is more preferably 2% by weight or lower, and is even more preferably, in a range of from 0.01% by weight to 1.5% by weight, and is most preferably, from 0.02% by weight to 1% by weight.

The glass transition temperature (Tg) of the polymer latex according to the present invention is preferably in a range of from 0° C. to 80° C., more preferably from 10° C. to 70° C. and, even more preferably from 15° C. to 60° C.

Specific examples of the polymer latex which can be used in the present invention include latexes of polyacrylate, polyurethane, polymethacrylate, and copolymers including these.

The polymer latex which can be used in the present invention may be of two or more kinds of polymers depending on needs. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, a layer containing a hydrophobic polymer is preferably formed by applying a coating solution containing 30% by weight or more of water in the solvent and by then drying.

A preferred embodiment of the polymer latex according to the present invention is such prepared to yield an ion conductivity of 2.5 mS/cm or lower, and as such a preparing method, there can be mentioned a refining treatment using a separation function membrane after synthesizing the polymer.

As a coating solvent, water or water containing mixed therein 70% by weight or less of a water-miscible organic solvent is preferred. As water-miscible organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

In the invention, an average particle diameter of the polymer latex is preferably in a range of from 1 nm to 50,000 nm, more preferably from 10 nm to 500 nm, and even more preferably from 50 nm to 200 nm. There is no particular limitation concerning a particle diameter distribution of the dispersed particles, and the particles may be widely distributed or may exhibit a monodisperse particle diameter distribution. From the viewpoint of controlling the physical properties of the coating solution, preferred mode of usage includes mixing two or more types of dispersed particles each having a monodisperse particle diameter distribution.

As the polymer, hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like can be used preferably. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

<Examples of Latex>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

NP-1; Latex of -MMA(70)-EA(27)-MAA(3)-(molecular weight 37000, Tg 61° C.)

NP-2; Latex of -MMA(70)-2EHA(20)-St(5)-AA(5)-(molecular weight 40000, Tg 59° C.)

NP-3; Latex of -St(50)-Bu(47)-MAA(3)-(crosslinking, Tg −17° C.)

NP-4; Latex of -St(68)-Bu(29)-AA(3)-(crosslinking, Tg 17° C.)

NP-5; Latex of -St(71)-Bu(26)-AA(3)-(crosslinking, Tg 24° C.)

NP-6; Latex of -St(70)-Bu(27)-IA(3)-(crosslinking)

NP-7; Latex of -St(75)-Bu(24)-AA(1)-(crosslinking, Tg 29° C.)

NP-8; Latex of -St(60)-Bu(35)-DVB(3)-MAA(2)-(crosslinking)

NP-9; Latex of -St(70)-Bu(25)-DVB(2)-AA(3)-(crosslinking)

NP-10; Latex of -VC(50)-MMA(20)-EA(20)-AN(5)-AA(5)-(molecular weight 80000)

NP-11; Latex of -VDC(85)-MMA(5)-EA(5)-MAA(5)-(molecular weight 67000)

NP-12; Latex of -Et(90)-MAA(10)-(molecular weight 12000)

NP-13; Latex of -St(70)-2EHA(27)-AA(3)-(molecular weight 130000, Tg 43° C.)

NP-14; Latex of -MMA(63)-EA(35)-AA(2)-(molecular weight 33000, Tg 47° C.)

NP-15; Latex of -St(70.5)-Bu(26.5)-AA(3)-(crosslinking, Tg 23° C.)

NP-16; Latex of -St(69.5)-Bu(27.5)-AA(3)-(crosslinking, Tg 20.5° C.)

NP-17; Latex of -St(61.3)-Isoprene(35.5)-AA(3)-(crosslinking, Tg 17° C.)

NP-18; Latex of -St(67)-Isoprene(28)-Bu(2)-AA(3)-(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

As the polymer latex used for the hydrophobic polymer layer of the present invention, particularly, latexes of acrylate copolymer, latexes of polyester, polyurethane, and the like are preferred.

Further, the polymer latex used for the hydrophobic polymer layer of the present invention preferably contains acrylic acid or methacrylic acid within an amount of from 1% by weight to 6% by weight, and more preferably from 2% by weight to 5% by weight. The polymer latex used for the hydrophobic polymer layer of the invention preferably contains acrylic acid.

The coating amount of the hydrophobic polymer is preferably from 0.1 $g/m^2$ to 10 $g/m^2$ per 1 $m^2$ of the support, and more preferably from 0.3 $g/m^2$ to 5 $g/m^2$.

And it is preferred that the concentration of the hydrophobic polymer in a coating solution is arranged to have suitable viscosity for simultaneous multilayer coating after the addition, but it is not specifically limited. Generally, the concentration of the hydrophobic polymer in a coating solution is from 5% by weight to 50% by weight, and is preferably from 10% by weight to 40% by weight, and particularly preferably from 15% by weight to 30% by weight.

<Matting Agent>

A matting agent is preferably added to the photothermographic material of the invention in order to improve transportability. Description on the matting agent can be found in paragraphs Nos. 0126 and 0127 of JP-A No. 11-65021. The addition amount of the matting agent is preferably in a range of from 1 $mg/m^2$ to 400 $mg/m^2$, and more preferably, from 5 $mg/m^2$ to 300 $mg/m^2$, with respect to the coating amount per 1 $m^2$ of the photothermographic material.

The shape of the matting agent usable in the invention may fixed form or non-fixed form. Preferred is to use those having fixed form and globular shape.

Volume weighted mean equivalent spherical diameter of the matting agent used in the image forming layer surface is preferably in a range of from 0.3 μm to 10 μm, and more preferably, from 0.5 μm to 7 μm.

Further, the particle distribution of the matting agent is preferably set as such that the variation coefficient becomes from 5% to 80%, and more preferably, from 20% to 80%. The variation coefficient, herein, is defined by (the standard deviation of particle diameter)/(mean diameter of the particle)×100. Furthermore, two or more kinds of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in a range of from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more kinds of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more when expressed by Beck's smoothness.

In the present invention, a matting agent is preferably contained in the outermost layer, in a layer which functions as a surface protective layer, or in a layer near to the outermost layer.

<Lubricant>

To improve handling facility during manufacturing process or resistance to scratch during thermal development, it is preferred to use a lubricant such as a liquid paraffin, a long chain fatty acid, an amide of a fatty acid, an ester of a fatty acid, or the like. Particularly preferred are a liquid paraffin obtained by removing components having a low boiling point and an ester of a fatty acid having a branch structure and a molecular weight of 1000 or more.

Concerning lubricants, compounds described in paragraph No. 0117 of JP-A No. 11-65021 and in JP-A Nos. 2000-5137, 2004-219794, 2004-219802, and 2004-334077 are preferable.

The addition amount of the lubricant is in a range of from 1 mg/m$^2$ to 200 mg/m$^2$, preferably from 10 mg/m$^2$ to 150 mg/m$^2$, and more preferably in a range of from 20 mg/m$^2$ to 100 mg/m$^2$.

The lubricant is added in any layer of the image forming layer and the non-image-forming layer, but from the purpose to improve transportability and resistance to scratch defect, it is preferred to add the lubricant in the outermost layer.

<Surfactant>

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411, 2003-57780, and 2003-149766 are preferably used. Especially, the usage of the fluorocarbon surfactants described in JP-A Nos. 2003-57780 and 2003-149766 in an aqueous coating solution is preferred viewed from the standpoint of capacity in static control, stability of the coated surface state and sliding facility. The fluorocarbon surfactant described in JP-A No. 2003-149766 is most preferred because of high capacity in static control and that it needs small amount to use.

According to the invention, the fluorocarbon surfactant can be used on either side of image forming layer side or backside, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$ Especially, the fluorocarbon surfactant described in JP-A No. 2003-149766 is effective, and used preferably in a range of from 0.01 mg/m$^2$ to 10 mg/m$^2$, and more preferably, in a range of from 0.1 mg/m$^2$ to 5 mg/m$^2$.

6) Antihalation Layer

The photothermographic material of the present invention can comprise an antihalation layer provided to the side farther from the light source than the image forming layer. The antihalation layer is disposed between the support and the image forming layer, or on the backside.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used in an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally from 0.001 g/m$^2$ to 1 g/m$^2$.

By decoloring the dye in such a manner, the optical density after thermal development can be lowered to 0.1 or lower. Two or more types of thermal bleaching dyes may be used in combination in a photothermographic material. Similarly, two or more types of base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone, 2-naphthylbenzoate, or the like) as disclosed in JP-A No. 11-352626.

7) Back Layer

Back layers usable in the invention are described in paragraph Nos. 0128 to 0130 of JP-A No. 11-65021.

In the invention, coloring matters having maximum absorption in the wavelength range from 300 nm to 450 nm can be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 mg/m$^2$ to 1 g/m$^2$, preferably to the back layer which is provided on the side opposite to the image forming layer.

Further, in order to control the basic color tone, it is preferred to use a dye having an absorption peak in a wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming layer side, or on the backside.

8) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles with a ratio of (the major axis)/(the minor axis) being 2.0 or higher, and more preferably in a range of from 3.0 to 50, is preferred viewed from the standpoint of the electric conductivity effect. The metal oxides is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$.

The antistatic layer may be laid on either side of the image forming layer side or the backside, but it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

9) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower when coating for image forming layer and back layer is conducted on the support.

10) Other Additives

Furthermore, an antioxidant, stabilizing agent, plasticizer, UV absorbent, or film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

11) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837,095.

Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which can form image on the photothermographic material without using other sheets such as an image-receiving material).

12) Wrapping Material

In order to suppress fluctuation from occurring on photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

13) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298.

(Image Forming Method)

The photothermographic material of the present invention may be either "single-sided type" having an image forming layer on one side of the support, or "double-sided type" having image forming layers on both sides of the support.

1) Double-sided Type Photothermographic Material

The photothermographic material of the present invention can be preferably applied for an image forming method to record X-ray images using a fluorescent intensifying screen.

The image forming method using the photothermographic materials described above comprises:

(a) providing an assembly for forming an image by placing the photothermographic material between a pair of the X-ray intensifying screens, (b) putting an analyte between the assembly and the X-ray source, (c) applying X-rays having an energy level in a range of 25 kVp to 125 kVp to the analyte;

(d) taking the photothermographic material out of the assembly; and (e) heating the removed photothermographic material in a temperature range of from 90° C. to 180° C.

The photothermographic material used for the assembly in the present invention is subjected to X-ray exposure through a step wedge tablet and thermal development. On the photographic characteristic curve having an optical density (D) and an exposure value (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0.

For the X-ray radiography employed in the practice of the present invention, the use of photothermographic material having the aforesaid photographic characteristic curve would give the radiation images with excellent photographic properties that exhibit an extended bottom portion and high gamma value at a middle density area. According to this photographic property, the photographic properties mentioned have the advantage of that the depiction in a low density portion on the mediastinal region and the heart shadow region having little X-ray transmittance becomes excellent, and that the density becomes easy to view, and that gradation in the images on the lung field region having much X-ray transmittance becomes excellent.

The photothermographic material having a preferred photographic characteristic curve mentioned above can be easily prepared, for example, by the method where each of the image forming layer of both sides is constituted of two or more image forming layers containing silver halide and having a sensitivity different from each other.

Especially, the aforesaid image forming layer preferably comprises an emulsion of high sensitivity for the upper layer and an emulsion with photographic properties of low sensitivity and high gradation for the lower layer.

In the case of preparing the image forming layer comprising two layers, the sensitivity difference between the silver halide emulsion in each layer is preferably from 1.5 times to 20 times, and more preferably from 2 times to 15 times.

The ratio of the amounts of emulsion used for forming each layer may depend on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in a range of from 1:20 to 1:50 based on silver amount.

As the techniques for crossover cutting (in the case of double-sided photosensitive material) and anti-halation (in the case of single-sided photosensitive material), dyes or combined use of dye and mordant described in JP-A. No. 2-68539, (from page 13, left lower column, line 1 to page 14, left lower column, line 9) can be employed.

Next, the fluorescent intensifying screen of the present invention is explained below. The fluorescent intensifying screen essentially comprises a support and a fluorescent substance layer coated on one side of the support as the fundamental structure. The fluorescent substance layer is a layer where the fluorescent substance is dispersed in a binder. On the surface of a fluorescent substance layer opposite to the support side (the surface of the side that does not face on the support), a transparent protective layer is generally disposed to protect the fluorescent substance layer from chemical degradation and physical shock.

The fluorescent intensifying screen which is more preferred for the present invention is a screen where 50% or more of the emission light has a wavelength region from 350 nm to 420 nm. Especially, as the fluorescent substance, a divalent europium activated fluorescent substance is preferred, and a divalent europium activated barium halide fluorescent substance is more preferred. The emission wavelength region is preferably from 360 nm to 420 nm, and more preferably from 370 nm to 420 nm. Moreover, the preferred fluorescent screen can emit 70% or more of the above region, and more preferably 85% or more thereof.

The ratio of the emission light can be calculated from the following method; the emission spectrum is measured where an antilogarithm of the emission wavelength is plotted on the abscissa axis at equal interval and a number of the emitted photon is plotted on the ordinate. The ratio of the emission light in the wavelength region from 350 nm to 420 nm is defined as a value dividing the area from 350 nm to 420 nm on the chart by the entire area of the emission spectrum. The black and white photothermographic materials of the present invention used in combination with the fluorescent substance emitting the above wavelength region can attain high sensitivity.

In order that most of the emission light of the fluorescent substance may exist in the above wavelength region, the narrower half band width is preferred. The preferred half band width is from 1 nm to 70 nm, more preferably from 5 nm to 50 nm, and even more preferably from 10 nm to 40 nm.

So long as the fluorescent substance has the above emission, the fluorescent substance used in the present invention is not particularly limited, but the europium activated fluorescent substance where the divalent europium is an emission center is preferred to attain high sensitivity as the purpose of the invention. Specific examples of these fluorescent substances are described below, but the scope of the present invention is not limited to the examples.

BaFCl:Eu, BaFBr:Eu, BaFI:Eu, and the fluorescent substances where their halogen composition is changed; $BaSO_4$:Eu, SrFBr:Eu, SrFCl:Eu, SrFI:Eu, $(Sr,Ba)Al_2Si_2O_8$:Eu, $SrB_4O_7F$:Eu, $SrMgP_2O_7$:Eu, $Sr_3(PO_4)_2$:Eu, $Sr_2P_2O_7$:Eu, and the like.

More preferred fluorescent substance is a divalent europium activated barium halide fluorescent substance expressed by the following formula:

$$MX_1X_2:Eu$$

wherein, M represents Ba as a main component, but a small amount of Mg, Ca, Sr, or other compounds may be included. $X_1$ and $X_2$ each represent a halogen atom, and can be selected from F, Cl, Br, or I.

Herein, $X_1$ is more preferably a fluorine atom. $X_2$ can be selected from Cl, Br, or I, and the mixture with other halogen composition can be used preferably. More preferably X=Br. Eu represents an europium atom. Eu as an emission center is preferably contained at a ratio from $10^{-7}$ to 0.1, based on Ba, more preferably from $10^{-4}$ to 0.05. Preferably the mixture with a small quantity of other compounds can be included. As most preferred fluorescent substance, BaFCl:Eu, BaFBr:Eu, and $BaFBr_{1-x}I_x$:Eu can be described.

The fluorescent intensifying screen preferably consists of a support, an undercoat layer on the support, a fluorescent substance layer, and a surface protective layer.

The fluorescent substance layer is prepared as follows. A dispersion solution is prepared by dispersing the fluorescent substance particles described above in an organic solvent solution containing binder resins. The thus-prepared solution is coated directly on the support (or on the undercoat layer such as a light reflective layer provided beforehand on the support) and dried to form the fluorescent substance layer. Besides the above method, the fluorescent substance layer may be formed by the steps of coating the above dispersion solution on the temporary support, drying the coated dispersion to form a fluorescent substance layer sheet, peeling off the sheet from the temporary support, and fixing the sheet onto a permanent support by means of an adhesive agent.

The particle size of the fluorescent substance particles used in the present invention is not particularly restricted, but is usually in a range of from about 1 μm to 15 μm, and preferably from about 2 μm to 10 μm. The higher volume filling factor of the fluorescent substance particles in the fluorescent substance layer is preferred, usually in the range of from 60% to 85%, preferably from 65% to 80%, and particularly preferably from 68% to 75%. (The ratio of the fluorescent substance particles in the fluorescent substance layer is usually 80% by weight or more, preferably 90% by weight or more, and particularly preferably 95% by weight or more). Various kinds of known documents have described the binder resins, organic solvents, and the various additives used for forming the fluorescent substance layer. The thickness of the fluorescent substance layer may be set arbitrary according to the target sensitivity, but is preferably in a range of from 70 μm to 150 μm for the front side screen, and in a range of from 80 μm to 400 μm for the backside screen. The X-ray absorption efficiency of the fluorescent substance layer depends on the coating amount of the fluorescent substance particles in the fluorescent substance layer.

The fluorescent substance layer may consist of one layer, or may consist of two or more layers. It preferably consists of one to three layers, and more preferably, one or two layers. For example, the layer may be prepared by coating a plurality of layers comprising the fluorescent substance particles with different particle size having a comparatively narrow particle size distribution. In that case, the particle size of the fluorescent substance particles contained in each layer may gradually decrease from the top layer to the bottom layer provided next to the support. Especially, the fluorescent substance particles having a large particle size is preferably coated at the side of the surface protective layer and fluorescent substance particles having a small particle size is preferably coated at the side of the support. Hereto, the small particle size of fluorescent substance is preferably in the range from 0.5 μm to 2.0 μm and the large size is preferably in the range from 10 μm to 30 μm. The fluorescent substance layer may be formed by mixing the fluorescent substance particles with different particle sizes, or the fluorescent substances may be packed in a particle size graded structure as described in JP-A No. 55-33560 (page 3, line 3 on the left column to page 4, line 39 on the left column). Usually, a variation coefficient of a particle size distribution of the fluorescent substance is in a range of from 30% to 50%, but a monodispersed fluorescent substance particles with a variation coefficient of 30% or less can also be preferably used.

Attempts to attain a desired sharpness by dying the fluorescent substance layer with respect to the emission light wavelength are practiced. However, the layer with least dying is preferably required. The absorption length of the fluorescent substance layer is preferably 100 μm or more, and more preferably 1000 μm or more.

The scattering length of the fluorescent substance layer is preferably designed to be from 0.1 μm to 100 μm, and more preferably from 1 μm to 100 μm. The scattering length and the absorption length can be calculated from the equation based on the theory of Kubelka-Munk mentioned below.

As the support, any support can be selected from various kinds of supports used in the well-known fluorescent intensifying screens depending on the purpose. For example, a polymer film containing white pigments such as titanium dioxide or the like, and a polymer film containing black pigments such as carbon black or the like may be preferably used. An undercoat layer such as a light reflective layer containing a light reflective agent may be preferably coated on the surface of the support (the surface of the fluorescent substance layer side). The light reflective layer as described in JP-A No. 2001-124898 may be preferably used. Especially, the light reflective layer containing yttrium oxide described in Example 1 of the above patent or the light reflective layer described in Example 4 thereof is preferred. As for the preferred light reflective layer, the description in JP-A No. 23001-124898 (paragraph 3, 15 line on the right side to paragraph 4, line 23 on the right side) can be referred.

A surface protective layer is preferably coated on the surface of the fluorescent substance layer. The light scattering length measured at the main emission wavelength of the fluorescent substance is preferably in a range of from 5 μm to 80 μm, and more preferably from 10 μm to 70 μm, and particularly preferably from 10 μm to 60 μm. The light scattering length indicates a mean distance in which a light travels straight until it is scattered. Therefore a short scattering length means that the light scattering efficiency is high. On the other hand, the light absorption length, which indicates a mean free distance until a light is absorbed, is optional. From the viewpoint of the screen sensitivity, no absorption by the surface protective layer favors preventing the desensitization. In order to compensate the scattering loss, a very slightly absorption may be allowable. A preferred absorption length is 800 μm or more, and more preferably 1200 μm or more. The light scattering length and the light absorption length can be calculated from the equation based on the theory of Kubelka-Munk using the measured data obtained by the following method.

Three or more film samples comprising the same component composition as the surface protective layer of the aimed sample but having a different thickness from each other are prepared, and then the thickness (μm) and the diffuse transmittance (%) of each of the samples is measured. The diffuse transmittance can be measured by means of a conventional spectrophotometer equipped with an integrating sphere. For the measurement of the present invention, an automatic recording spectrophotometer (type U-3210, manufactured by Hitachi Ltd.) equipped with an integrating sphere of 150 ϕ (150-0901) is used. The measuring wavelength must correspond to the wavelength of the main emission peak of the fluorescent substance in the fluorescent substance layer having the surface protective layer. Thereafter, the film thickness (μm) and the diffuse transmittance (%) obtained in the above measurement is introduced to the following equation (A) derived from the theoretical equation of Kubelka-Munk. For example, the equation (A) can be derived easily, under the boundary condition of the diffuse transmittance (%), from the equations 5·1·12 to 5·1·15 on page 403 described in "Keikotai Hando Bukku" (the Handbook of Fluorescent Substance) (edited by Keikotai Gakkai, published by Ohmsha Ltd. 1987).

$$T/100=4\beta/[(1+\beta)^2\cdot\exp(\alpha\, d)-(1-\beta)^2\cdot\exp(-\alpha\, d)] \qquad \text{Equation (a)}$$

wherein, T represents a diffuse transmittance (%), d represents a film thickness (μm) and, α and β are defined by the following equation respectively.

$$\alpha=[K\cdot(K+2S)]^{1/2}$$

$$\beta=[K/(K+2S)]^{1/2}$$

T (diffuse transmittance: %) and d (film thickness: μm) measured from three or more film samples are introduced respectively to the equation (A), and thereby the value of K and S are determined to satisfy the equation (A).

The scattering length (μm) and the absorption length (μm) are defined by 1/S and 1/K respectively.

The surface protective layer may preferably comprise light scattering particles dispersed in a resin material. The light refractive index of the light scattering particles is usually 1.6 or more, and more preferably 1.9 or more. The particle size of the light scattering particles is in a range of from 0.1 μm to 1.0 μm. Examples of the light scattering particles may include fine particles of aluminum oxide, magnesium oxide, zinc oxide, zinc sulfide, titanium oxide, niobium oxide, barium sulfate, lead carbonate, silicon oxide, poly(methyl methacrylate), styrene, and melamine.

The resin materials used to form the surface protective layer are not particularly limited, but poly(ethylene terephthalate), poly(ethylene naphthalate), polyamide, aramid, fluororesin, polyesters, or the like are preferably used. The surface protective layer can be formed by the step of dispersing the light scattering particles set forth above in an organic solvent solution containing the resin material (binder resin) to prepare a dispersion solution, coating the dispersion solution on the fluorescent substance layer directly (or via an optionally provided auxiliary layer), and then drying the coated solution. By other way, the surface protective sheets prepared separately can be overlaid on the fluorescent substance layer by means of an adhesive agent. The thickness of the surface protective layer is usually in a range of from 2 μm to 12 μm, and more preferably from 3.5 μm to 10 μm.

In addition, in respect with the preferred producing methods and the materials used for the process of the radiographic intensifying screen, references can be made to various publications, for example, JP-A No. 9-21899 (page 6, line 47 on left column to page 8, line 5 on left column), JP-A No. 6-347598 (page 2, line 17 on right column to page 3, line 33 on left column) and (page 3, line 42 on left column to page 4, line 22 on left column).

In the fluorescent intensifying sheets used for the present invention, the fluorescent substance is preferably packed in a particle diameter graded structure. Especially, the fluorescent substance particles having a large particle diameter are preferably coated at the side of the surface protective layer and fluorescent substance particles having a small particle diameter are preferably coated at the side of the support. The small particle diameter of fluorescent substance is preferably in a range of from 0.5 μm to 2.0 μm, and the large particle diameter is preferably in a range of from 10 μm to 30 μm.

2) Single-sided Type Photothermographic Material

The single-sided type photothermographic material of the present invention is preferably applied for an X-ray photosensitive material used for mammography.

To use the single-sided type photothermographic material for that purpose, it is very important to design the gradation of the obtained image in a suitable range.

Concerning the preferable constitution for a photosensitive material used for mammography, reference can be made to JP-A Nos. 5-45807, 10-62881, 10-54900, 11-109564.

3) Combined Use with Ultraviolet Fluorescent Intensifying Screen

Concerning the image forming method using photothermographic material of the present invention, it is preferred that the image forming method is performed in combination with a fluorescent substance having a main emission peak at 400 nm or lower. And more preferably, the image forming method is performed in combination with a fluorescent substance having a main emission peak at 380 nm or lower. Either single-sided photosensitive material or double-sided photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cutting (for double-sided photosensitive material) and anti-halation (for single-sided photosensitive material) of ultraviolet light, the technique described in JP-A No. 8-76307 can be applied. As ultraviolet absorbing dyes, the dye described in JP-A No. 2001-144030 is particularly preferred.

4) Thermal Development

Although any method may be used for developing the photothermographic material of the invention, development is usually performed by elevating the temperature of the photothermographic material exposed imagewise. The temperature for development is preferably from 80° C. to 250° C., and more preferably, from 100° C. to 140° C. Time period for development is preferably in a range of from 1 second to 60 seconds, more preferably from 5 seconds to 30 seconds, and particularly preferably from 5 seconds to 20 seconds.

In the process of thermal development, a process using a plate type heater is preferred. A preferable process for thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by about 1° C. to 10° C.

Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

5) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material and the image forming method of the invention are preferably employed as photothermographic materials for use in medical diagnosis, photothermographic materials for use in industrial photographs, photothermographic materials for use in graphic arts, as well as for COM, through forming black and white images by silver imaging, and the image forming method using the same.

EXAMPLES

The present invention is specifically explained by way of Examples below, which should not be construed as limiting the invention thereto.

Example 1

1. Preparation of PET Support and Undercoating 1-1. Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

1-3. Undercoating

1) Preparation of Coating Solution for Undercoat Layer

| Formula (1) (for undercoat layer on the image forming layer side) | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethyleneglycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| Distilled water | 931 mL |

2) Undercoating

Both surfaces of the aforementioned biaxially tentered polyethylene terephthalate support having the thickness of 175 μm were subjected to the corona discharge treatment as described above. Thereafter, the aforementioned formula (1) of the coating solution for the undercoat was coated with a wire bar so that the amount of wet coating became 6.6 mL/m$^2$ (per one side), and dried at 180° C. for 5 minutes. This was subjected on both sides and thus, an undercoated support was produced.

2. Preparations of Coating Material

1) Preparation of Photosensitive Silver Halide Emulsion A

—Preparation of Host Grains—

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2.

Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2.

Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver.

The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

Thereby an unripened pure silver iodide emulsion was prepared.

The obtained silver halide grains had a mean projected area equivalent diameter of 0.93 μm, a variation coefficient of a projected area equivalent diameter distribution of 17.7%, a mean thickness of 0.057 μm, and a mean aspect ratio of 16.3. Tabular grains having an aspect ratio of 2 or more occupied 80% or more of the total projected area. A mean equivalent spherical diameter of the grains was 0.42 μm. 30% or more of the silver iodide existed in y phase from the result of powder X-ray diffraction analysis.

—Preparation of Epitaxial Junction Portion—

1 mol of the unripened emulsion described above was poured into a reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

—Chemical Sensitization—

The above-mentioned silver halide emulsion having an epitaxial junction portion were kept at 38° C. with stirring, and to each was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes.

Then, 1.3 mL of a 0.8% by weight N,N'-dihydroxy-N", N"-diethylmelamine in methanol solution was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added.

<Preparation of Emulsion for Coating Solution>

The above-described silver halide emulsion was dissolved and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried.

The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone.

The temperature inside of the reaction vessel was then set to be 30° C., and the temperature outside was controlled so that the liquid temperature could be kept constant.

In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Reducing Agent-1 Dispersion

To 10 kg of reducing agent-1 (1,1-bis(2-hydroxy-3,5-dimethylphenyl)-3,5,5-trimethylhexane) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion.

Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

4) Preparation of Nucleator Dispersion 2.5 g of poly(vinyl alcohol) (manufactured by Kuraray Co., Ltd., PVA-217) and 87.5 g of water were added to 10 g of nucleator SH-7, and thoroughly admixed to give a slurry. This slurry was allowed to stand for 3 hours.

Zirconia beads having a mean particle diameter of 0.5 mm were provided in an amount of 240 g, and charged in a vessel with the slurry. Dispersion was performed with a dispersing machine (1/4G sand grinder mill: manufactured by AIMEX Co., Ltd.) for 10 hours to obtain a solid fine particle dispersion of nucleator. Particles of the nucleator included in the resulting nucleator dispersion had a mean particle diameter of 0.5 μm, and 80% by weight of the particles had a particle diameter of 0.1 μm to 1.0 μm.

5) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight.

This dispersion was warmed at 40° C. for one hour, followed by a subsequent heat treatment at 80° C. for one hour to obtain hydrogen bonding compound-1 dispersion.

Particles of the hydrogen bonding compound included in the resulting hydrogen bonding compound dispersion had a median diameter of 0.45 ∞m, and a maximum particle diameter of 1.3 μm or less. The resultant hydrogen bonding compound dispersion was subjected to filtration with a polypropylene filter having a pore size of 3.0 μm to remove foreign substances such as dust, and stored.

6) Preparations of Dispersions of Development Accelerator and Dispersion of Color-tone-adjusting Agent <Preparation of Development Accelerator-1 Dispersion>

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained.

Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

<Preparations of Solid Dispersions of Development Accelerator-2 and Color-tone-adjusting Agent-1>

Also concerning solid dispersions of development accelerator-2 and color-tone-adjusting agent-1, dispersion was executed similar to the development accelerator-1, and thus dispersions of 20% by weight and 15% by weight were respectively obtained.

7) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained.

Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion.

Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Silver Iodide Complex-forming Agent Solution 8 kg of modified poly(vinyl alcohol) MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of 6-isopropylphthalazine. Accordingly, a 5% by weight solution of silver iodide complex-forming agent compound was prepared.

9) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of SBR Latex Liquid

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm.

As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, an ionic conductance of 4.80 mS/cm (measurement of the ionic conductance performed using a conductivity meter CM-30S manufactured by Toa Electronics Ltd. for the latex stock solution (44% by weight) at 25° C.), and the pH of 8.4.

3. Preparations of Coating Solution

1) Preparation of Coating Solution for Image Forming Layer

To the dispersion of silver salt of a fatty acid obtained as described above in an amount of 1000 g and 276 mL of water were serially added the organic polyhalogen compound-1 dispersion, the organic polyhalogen compound-2 dispersion, the SBR latex (Tg: 17° C.) liquid, the reducing agent-1 dispersion, the nucleator dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent solution, the emulsion for coating solution was added thereto in an amount of 0.22 mol by silver amount per 1 mol of the silver salt of a fatty acid, followed by thorough mixing just prior to the coating, which is fed directly to a coating die.

2) Preparation of Coating Solution for Intermediate Layer A

To 1000 g of poly(vinyl alcohol) PVA-205 (manufactured by Kuraray Co., Ltd.), 163 g of the pigment-1 dispersion, 33 g of a 18.5% by weight aqueous solution of blue dye compound (manufactured by Nippon Kayaku Co., Ltd.: Kayafect turquoise RN liquid 150), 27 mL of a 5% by weight aqueous solution of sodium di(2-ethylhexyl)sulfosuccinate, and 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 8.9 mL/$m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL $m^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In 800 mL of water were dissolved 100 g of inert gelatin and 10 mg of benzoisothiazolinone, and thereto were added 10 g of a 10% by weight liquid paraffin emulsion, 30 g of a 10% by weight emulsion of dipentaerythritol hexa-isostearate, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl)sulfosuccinate, 4 g of poly(methyl methacrylate) fine particles (mean particle diameter of 0.7 μm, volume weighted mean distribution of 30%), and 21 g of poly(methyl methacrylate) fine particles (mean particle diameter of 3.6 μm, volume weighted mean distribution of 60%), and the obtained mixture was mixed to give a coating solution for the surface protective layer, which was fed to a coating die so that 8.3 mL/$m^2$ could be provided.

Viscosity of the coating solution was 19 [mPa·s] which was measured with a B type viscometer at 40° C. (No. 1 rotor, 60 rpm).

4. Preparations of Photothermographic Material

1) Preparation of Photothermographic Material-101

Simultaneous overlaying coating by a slide bead coating method was subjected in order of the image forming layer, intermediate layer, first layer of the surface protective layers, and second layer of the surface protective layers, starting from the undercoated face. Thus samples of photothermographic material were produced.

In this method, the temperature of the coating solution was adjusted to 31° C. for the image forming layer and intermediate layer, to 36° C. for the first layer of the surface protective layers, and to 37° C. for the second layer of the surface protective layers. The amount of coated silver was 0.862 g/$m^2$ per one side, with respect to the sum of the silver salt of a fatty acid and silver halide. This was coated on both sides of the support.

The coating amount of each compound (g/$m^2$) for the image forming layer per one side is as follows.

| | |
|---|---|
| Silver salt of a fatty acid | 2.85 |
| Organic polyhalogen compound-1 | 0.028 |
| Organic polyhalogen compound-2 | 0.094 |

-continued

| | |
|---|---|
| Silver iodide complex-forming agent | 0.46 |
| SBR latex | 5.20 |
| Reducing agent-1 | 0.46 |
| Nucleator SH-7 | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.175 |

Conditions for coating and drying were as follows.

The support was decharged by ionic wind. Coating was performed at the speed of 160 m/min. Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared photothermographic material had a level of matting of 550 seconds as Beck's smoothness. In addition, measurement of the pH of the film surface gave the result of 6.0.

2) Preparations of Photothermographic Material-102 to -114

Preparations of photothermographic material-102 to -114 were conducted in a similar manner to the process in the preparation of photothermographic material-101, except that the second organic silver salt was added into the intermediate layer, the first layer of surface protective layers, or the second layer of surface protective layers of the photothermographic material-101, as described in the following Table 1. The following dispersions were employed for the second organic silver salt.

<Organic Silver Salt A: Silver Behenate Dispersion>

In the case where the second organic silver salt was added in the intermediate layer, the dispersion of silver salt of a fatty acid described above (organic silver salt A-1) was used as the silver behenate dispersion.

In the case where the second organic silver salt was added in the first layer of surface protective layers or the second layer of surface protective layers, 40 g of a 5% by weight aqueous solution of sodium di(2-ethylhexyl)sulfosuccinate, 80 g of a 5% by weight aqueous solution of inert gelatin, and 20 g of water were added to the above silver salt of a fatty acid corresponding to 260 kg of a dry solid matter content to give a slurry and then the slurry was subjected to preliminary dispersion with a pipeline mixer.

Next, the obtained preliminary dispersion was treated three times using a dispersing machine (trade name: Microfluidizer M-110EH, manufactured by Microfluidex International Corporation, using Z type Interaction Chamber) with the pressure controlled to be 1320 kg/cm$^2$ to give a silver behenate dispersion (organic silver salt A-2). For the cooling manipulation, coiled heat exchangers were equipped in front of and behind the interaction chamber respectively, and accordingly, the temperature for the dispersion was set to be 18° C. by regulating the temperature of the cooling medium.

<Organic Silver Salt B: Silver Laurate Dispersion>

In the case where the second organic silver salt was added in the intermediate layer, the organic silver salt dispersion (organic silver salt B-1) was prepared in a similar manner to the process in the preparation of the dispersion of silver salt of a fatty acid described above except that using 51.8 kg of lauric acid instead of using 88 kg of recrystallized behenic acid.

In the case where the second organic silver salt was added in the first layer of surface protective layers or the second layer of surface protective layers, the organic silver salt dispersion (organic silver salt B-2) was prepared in a similar manner to the process in the preparation of the above organic silver salt A-2.

<Organic Silver Salt C: Dispersion of Silver Salt of Benzotriazole>

A dispersion of silver salt of benzotriazole was prepared by the method described in Example 1 of JP-A No. 1-100177.

<Organic Silver Salt D: Dispersion of Silver Salt of 1-Phenyl-5-mercaptotetrazole>

A dispersion of silver salt of 1-phenyl-5-mercaptotetrazole was prepared by the method described in Example 1 of JP-A No. 1-100177.

<Organic Silver Salt E: Silver Phthalate Dispersion>

500 g of disodium phthalate was dissolved into 4500 g of water and the mixture was kept at 50° C. 4.16 liters of an aqueous solution containing 930 g of silver nitrate prepared separately was added to the disodium phthalate solution with stirring over 30 minutes. Thereafter, the resulting mixture was ripened while stirring for one hour, and then solid matters were filtered out with centrifugal filtration. The solid matters were washed with water until the electric conductivity of the filtrated water became 30 μS/cm. Organic silver salt E was prepared using the above organic silver salt corresponding to 123 kg of a dry solid matter content in a similar manner to the process in the preparation of organic silver salt A-2.

<Organic Silver Salt F: Dispersion of Silver Salt of Polymer P-1>

A dispersion of silver salt of the following polymer P-1 was prepared by the method described in Example 1 of JP-A No. 2003-330137.

P-1

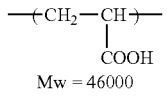

Mw = 46000

TABLE 1

| Sample No. | Organic Silver Salt in the Non-photosensitive Layer: Dispersion No. | Addition Amount (Ag: mol/m$^2$) | Added Layer | Photographic Properties: Fog | Sensitivity | Dmax | Fingerprint: Stain before Exposure | Image Tone | Scratch after Processing (number) | Note |
|---|---|---|---|---|---|---|---|---|---|---|
| 101 | — | — | — | 0.18 | 100 | 3.2 | X | X | 3 | Comparative |
| 102 | A-1 | $1 \times 10^{-3}$ | Intermediate layer | 0.18 | 98 | 3.2 | ○ | Δ | 1 | Invention |
| 103 | A-2 | $1 \times 10^{-3}$ | First layer of surface protective layers | 0.18 | 100 | 3.2 | ○ | ○ | 0 | Invention |
| 104 | A-2 | $1 \times 10^{-3}$ | Second layer of surface protective layers | 0.18 | 100 | 3.2 | ○ | ○ | 0 | Invention |
| 105 | B-1 | $1 \times 10^{-3}$ | Intermediate layer | 0.19 | 99 | 3.2 | ○ | Δ | 1 | Invention |
| 106 | B-2 | $1 \times 10^{-3}$ | First layer of surface protective layers | 0.18 | 100 | 3.2 | ○ | ○ | 0 | Invention |
| 107 | B-2 | $1 \times 10^{-3}$ | Second layer of surface protective layers | 0.18 | 100 | 3.2 | ○ | ○ | 0 | Invention |
| 108 | C | $1 \times 10^{-3}$ | First layer of surface protective layers | 0.17 | 100 | 3.2 | ◎ | ○ | 0 | Invention |
| 109 | C | $1 \times 10^{-3}$ | Second layer of surface protective layers | 0.17 | 100 | 3.2 | ◎ | ○ | 0 | Invention |
| 110 | D | $1 \times 10^{-3}$ | First layer of surface protective layers | 0.17 | 100 | 3.2 | ○ | ○ | 0 | Invention |
| 111 | D | $1 \times 10^{-3}$ | Second layer of surface protective layers | 0.17 | 100 | 3.2 | ○ | ○ | 0 | Invention |
| 112 | E | $1 \times 10^{-3}$ | First layer of surface protective layers | 0.18 | 100 | 3.2 | ○ | ○ | 0 | Invention |
| 113 | E | $1 \times 10^{-3}$ | Second layer of surface protective layers | 0.18 | 100 | 3.2 | ○ | ○ | 0 | Invention |
| 114 | F | $1 \times 10^{-3}$ | Intermediate layer | 0.18 | 100 | 3.2 | ○ | Δ | 1 | Invention |

Chemical structures of the compounds used in Examples of the invention are shown below.

Tellurium Sensitizer C

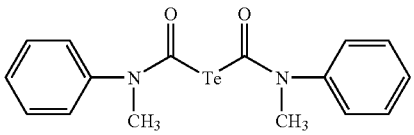

Compound 1 that can be one-electron-oxidized to provide a one-electron oxidation product which releases one or more electrons

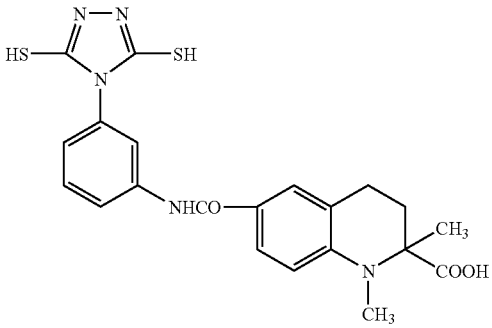

Compound 2 that can be one-electron-oxidized to provide a one-electron oxidation product which releases one or more electrons

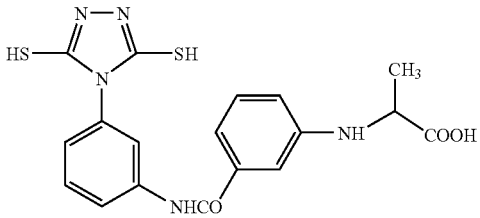

Compound 3 that can be one-electron-oxidized to provide a one-electron oxidation product which releases one or more electrons

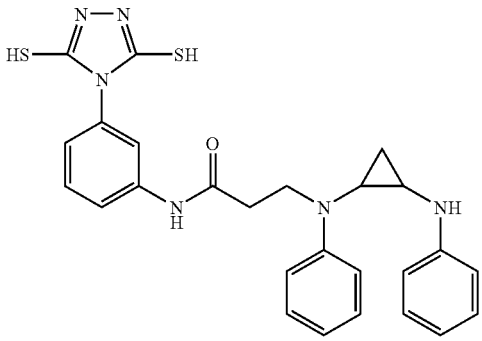

Compound 1 having adsorptive group and reducing group
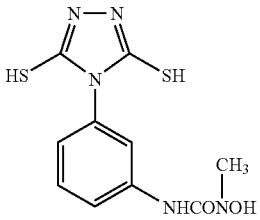
Compound 2 having adsorptive group and reducing group
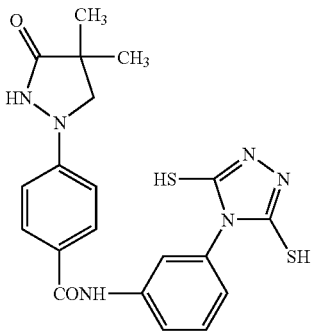
Reducing agent-1
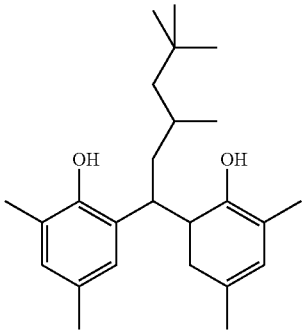
Nucleator SH-7
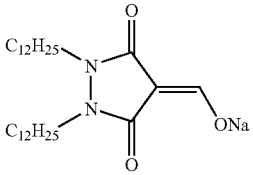
Hydrogen bonding compound-1
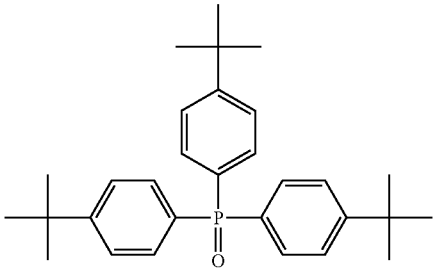
-continued
Organic polyhalogen compound-1
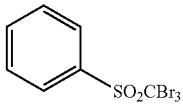
Organic polyhalogen compound-2
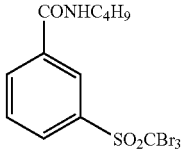
Mercapto compound-1
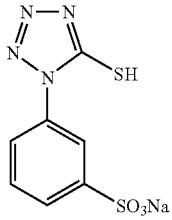
Mercapto compound-2
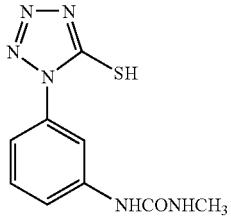
Silver iodide complex-forming agent
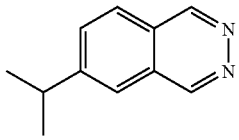
Development accelerator-1
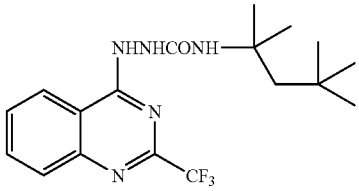

-continued

Development accelerator-2

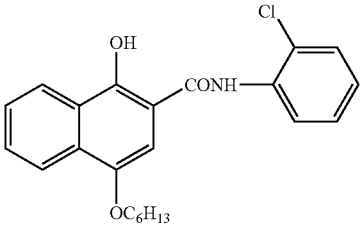

Color-tone-adjusting agent-1

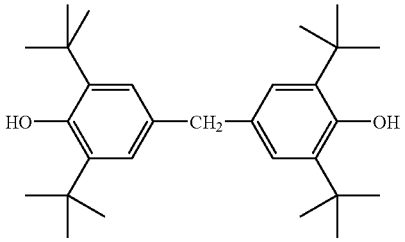

(F-1)

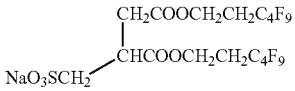

(F-2)

Mixture of

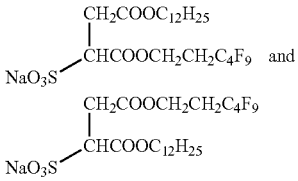

5. Evaluation of Performance

1) Preparation

The obtained sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

2) Exposure and Thermal Development

Thus prepared double-sided coated photothermographic material was evaluated as follows.

Two sheets of X-ray regular screen HI-SCREEN-B3 ($CaWO_4$ was used as fluorescent substance, the emission peak wavelength of 425 nm) produced by Fuji Photo Film Co., Ltd. were used, and the assembly for image formation was provided by inserting the sample between them.

This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. Changing the exposure value of X-ray by a distance method, the sample was subjected to exposure with a step wedge tablet having a width of 0.15 in terms of log E. After exposure, the exposed sample was subjected to thermal development with the condition mentioned below, and then the obtained image was evaluated by a densitometer.

The thermal developing portion of Fuji Medical Dry Laser Imager FM-DPL was modified so that it can heat from both sides, and by another modification the transportation rollers in the thermal developing portion were changed to the heating drum so that the sheet of film could be conveyed. The temperature of four panel heaters were set to 112° C.–118° C.–120° C.–120° C., and the temperature of the heating drum was set to 120° C. By increasing the speed of transportation, the total time period for thermal development was set to be 14 seconds.

3) Terms of Evaluation (Photographic Properties)

Densities of the obtained image were measured by using a Macbeth densitometer to draw a photographic characteristic curve representing a relationship between density and the common logarithm of exposure value.

Fog: The density of the non-image part was measured using a Macbeth densitometer.

Sensitivity: Sensitivity is the inverse of the exposure value giving image density of fog+1.0. The sensitivities are shown in a relative value, detecting the sensitivity of Sample No. 101 to be 100. The bigger the value is, it shows that sensitivity is higher.

(Image Tone)

The prepared sample was subjected to exposure to give a density of 1.2, and then was subjected to thermal development. Thereafter, image tone was evaluated by 10 persons. Results are rated by the following criteria and listed in the tables.

◎: Pure black tone, and excellent color tone.

○: Slightly yellowish tone, and allowable level for practical use, but one person points out the rank as an unfavorable color tone.

Δ: Strongly yellowish tone, and half of the members judge the rank as an unfavorable color tone.

X: Very strongly yellowish tone, and not allowable level for practical use. All persons judge the rank as an unfavorable color tone.

(Image Stability)

<Fingerprint Stain before Exposure>

In a dark room under an environment of 25° C. and 60RH %, the surfaces of the image forming layer of unexposed sample were touched by 10 persons with a hand, and then subjected to exposure for giving a density of 1.2 and thermal development. The obtained samples were sensory evaluated on the stain by fingerprint.

◎: Almost negligible stain.

○: Stain by fingerprint of one or two persons is observed, but in a slight degree.

Δ: Stain by fingerprint of three or more persons is observed in a serious degree.

X: Stain by fingerprint of five or more persons is observed in a significant degree.

(Evaluation on Resistance to Scratch after Processing)

The samples subjected to exposure to give a density of 3.0 and thermal development were prepared and the surfaces of the image forming layer were rubbed by a commercial nylon scrubbing pad at a scrubbing speed of 1 cm per second with a load of 20 $g/cm^2$. After rubbing thereto, the film surfaces were visually observed and the number of the scratched trace was counted. The smaller the number is, the better the resistance is.

The obtained results are shown in Table 1.

4) Result

By incorporating an organic silver salt in the non-photosensitive layer of the present invention, improvements in image tone, fingerprint stain before exposure, and scratch after processing can be attained. Especially, the addition of organic silver salt C (silver salt of benzotriazole) results in the most remarkable improvement.

Example 2

1. Preparations of Sample

The following intermediate layer A-2, intermediate layer B, and outermost layer were disposed instead of the intermediate layer A, the first layer of surface protective layers, and the second layer of surface protective layers in sample No. 108 of Example 1, respectively.

To each layer was added the organic silver salt described in Table 2, similar to Example 1.

<<Intermediate Layer A-2>>

To 60 g of poly(vinyl alcohol) PVA-205 (manufactured by Kuraray Co., Ltd.), 27 mL of a 5% by weight aqueous solution of sodium di(2-ethylhexyl)sulfosuccinate, 7894 g of a 41% by weight solution of polymer latex No. P-31 represented by formula (M), 27 mL of a 5% by weight aqueous solution of aerosol OT (manufactured by American Cyanamid Co.), and 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 8.9 mL/m$^2$.

<<Intermediate Layer B>>

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/m$^2$.

<<Outermost Layer>>

In 800 mL of water were dissolved 100 g of inert gelatin and 10 mg of benzoisothiazolinone, and thereto were added 40 g of a 10% by weight liquid paraffin emulsion, 40 g of a 10% by weight emulsion of dipentaerythritol hexa-isostearate, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl)sulfosuccinate, 4 g of poly(methyl methacrylate) fine particles (mean particle diameter of 0.7 μm, volume weighted mean distribution of 30%), and 21 g of poly(methyl methacrylate) fine particles (mean particle diameter of 3.6 μm, volume weighted mean distribution of 60%), and the obtained mixture was mixed, which was fed to a coating die so that 8.3 mL/m$^2$ could be provided.

TABLE 2

| | Intermediate Layer A-2 | | Intermediate Layer B | | Outermost Layer | | |
|---|---|---|---|---|---|---|---|
| Sample No. | Organic Silver Salt No. | Addition Amount (Ag: mol/m$^2$) | Organic Silver Salt No. | Addition Amount (Ag: mol/m$^2$) | Organic Silver Salt No. | Addition Amount (Ag: mol/m$^2$) | Note |
| 200 | — | — | — | — | — | — | Comparative |
| 201 | — | — | C | $1 \times 10^{-3}$ | — | — | Invention |
| 202 | — | — | — | — | C | $1 \times 10^{-3}$ | Invention |
| 203 | A-1 | $1 \times 10^{-3}$ | — | — | — | — | Invention |
| 204 | B-1 | $1 \times 10^{-3}$ | — | — | — | — | Invention |
| 205 | B-1 | $1 \times 10^{-3}$ | C | $1 \times 10^{-3}$ | — | — | Invention |

In the coating solution for the intermediate layer A-2, the mixing ratio (mass ratio of solid content) of PVA/polymer latex was 20/80.

2. Evaluation of Performance

The obtained samples were evaluated similar to Example 1, and the obtained results are shown in Table 3.

TABLE 3

| Sample | | Photographic Properties | | Fingerprint Stain | Scratch after | |
|---|---|---|---|---|---|---|
| No. | Image Tone | Fog | Sensitivity | before Exposure | Processing (number) | Note |
| 200 | X | 0.18 | 100 | X | 2 | Comparative |
| 201 | ○ | 0.17 | 99 | ○ | 0 | Invention |
| 202 | ○ | 0.17 | 99 | ○ | 0 | Invention |
| 203 | Δ | 0.18 | 100 | ○ | 1 | Invention |
| 204 | Δ | 0.18 | 100 | ○ | 1 | Invention |
| 205 | ○ | 0.17 | 99 | ◎ | 0 | Invention |

Concerning the photothermographic material having the intermediate layer A-2, B or the outermost layer, effects similar to Example 1 were obtained.

Example 3

An experiment was conducted similar to Example 1, except that the following fluorescent intensifying screen A was used instead of X-ray regular screen H1-SCREEN-B3 in Example 1.

As a result, the photothermographic materials of the present invention give preferable results similar to those in Example 1.

(Preparation of Fluorescent Intensifying Screen A)

1) Preparation of Undercoat Layer

A light reflecting layer comprising alumina powder was coated on a polyethylene terephthalate film (support) having a thickness of 250 μm in a similar manner to Example 4 in JP-A. No. 2001-124898. The light reflecting layer which had a film thickness of 50 μm after drying, was prepared.

2) Preparation of Fluorescent Substance Sheet 250 g of BaFBr:Eu fluorescent substance (mean particle size of 3.5 μm). 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 1001) and 0.5 g of isocyanate compounds (manufactured by Nippon Polyurethane Industry Co., Ltd., trade name: CORONATE HX) were added into methylethylketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

3) Overlaying the Fluorescent Substance Sheet on Light Reflective Layer

The fluorescent substance sheet prepared above was overlaid on the surface of the light reflective layer of the support having a light reflective layer made in the above process (1), and then pressed by a calendar roller at the pressure of 400 kgw/cm$^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

4) Preparation of Surface Protective Layer

Polyester type adhesive agents were coated on one side of a polyethylene terephthalate (PET) film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

5) Emission Characteristics

The emission spectrum of the intensifying screen A was measured by X-ray at 40 kVp and is shown in FIG. 1.

The fluorescent intensifying screen A showed an emission having a peak at 390 nm and a narrow half band width.

Example 4

An experiment similar to Example 3 was conducted, except that the following fluorescent intensifying screen was used instead of fluorescent intensifying screen A in Example 3.

As a result, the photothermographic materials of the present invention give preferable results similar to those in Example 3.

(Preparations of Fluorescent Intensifying Screen)

Preparations of fluorescent intensifying screen C, D, and E were conducted in a similar manner to the process in the preparation of fluorescent intensifying screen A, except that changing the coating amount of the fluorescent substance coating solution. The thickness of the fluorescent substance layer and the volume filling factor of the fluorescent substance in the obtained fluorescent intensifying screen are shown in Table 4.

TABLE 4

| Fluorescent Intensifying Screen | Fluorescent Substance | Thickness of Fluorescent Substance Layer (μm) | Volume Filling Factor of Fluorescent Substance (%) |
|---|---|---|---|
| A | BaFBr:Eu | 125 | 68 |
| C | BaFBr:Eu | 70 | 70 |
| D | BaFBr:Eu | 160 | 66 |
| E | BaFBr:Eu | 250 | 64 |

(Condition for Imagewise Exposure)

The photothermographic materials were subjected to X-ray exposure in combination with the fluorescent intensifying screen as described below. The frontscreen used herein means a screen located in near side to X-ray source against the material, and the backscreen herein means a screen located in far side from X-ray source.

TABLE 5

| Frontscreen | Backscreen |
|---|---|
| A | A |
| C | C |
| C | A |
| C | D |
| C | E |
| A | E |

What is claimed is:

1. A photothermographic material comprising, on at least one side of a support, an image forming layer comprising at least a photosensitive silver halide, a first organic silver salt, a reducing agent, and a binder, and at least one non-photosensitive layer which is disposed on the same side as the image forming layer and farther from the support than the image forming layer, wherein:

50% or more of a total projected area of the photosensitive silver halide is occupied by tabular grains having a silver iodide content of 40 mol % or higher and an aspect ratio of 2 or more; and the non-photosensitive layer comprises a second organic silver salt.

2. The photothermographic material according to claim 1, wherein the second organic silver salt contained in the non-photosensitive layer is at least one selected from a silver salt of a fatty acid, a silver salt of a mercapto compound, and a silver salt of a nitrogen-containing heterocyclic compound.

3. The photothermographic material according to claim 2, wherein the silver salt of a fatty acid is a silver salt of a saturated fatty acid having 11 to 27 carbon atoms.

4. The photothermographic material according to claim 3, wherein the silver salt of a fatty acid is at least one selected from the group consisting of silver behenate, silver stearate, silver arachidinate, and silver laurate.

5. The photothermographic material according to claim 2, wherein the silver salt of a nitrogen-containing heterocyclic compound is a silver salt of an azole compound.

6. The photothermographic material according to claim 5, wherein the silver salt of an azole compound is a silver salt of a benzotriazole compound.

7. The photothermographic material according to claim 2, wherein the silver salt of a mercapto compound is a silver salt of a nitrogen-containing heterocyclic mercapto compound.

8. The photothermographic material according to claim 1, wherein 50% by weight or more of a solvent of a coating solution for the image forming layer is water.

9. The photothermographic material according to claim 8, wherein 50% by weight or more of the binder in the image forming layer is formed by a hydrophobic polymer latex.

10. The photothermographic material according to claim 1, wherein 50% by weight or more of a solvent of a coating solution for the non-photosensitive layer is water.

11. The photothermographic material according to claim 10, wherein 50% by weight or more of binder in the non-photosensitive layer is formed by a hydrophobic polymer latex.

12. The photothermographic material according to claim 10, wherein 50% by weight or more of binder in the non-photosensitive layer is formed by a hydrophilic polymer.

13. The photothermographic material according to claim 1, which comprises a second non-photosensitive layer between the image forming layer and the non-photosensitive layer comprising the second organic silver salt, wherein 50% by weight or more of binder in the second non-photosensitive layer is formed by a hydrophobic polymer latex.

14. The photothermographic material according to claim 13, wherein the hydrophobic polymer latex is a polymer latex comprising a monomer component represented by the following formula (M):

$$CH_2{=}CR^{01}{-}CR^{02}{=}CH_2 \qquad \text{Formula (M)}$$

wherein $R^{01}$ and $R^{02}$ each independently represent one selected from a hydrogen atom, an alkyl group having 1 to 6 carbon atoms, a halogen atom, or a cyano group.

15. The photothermographic material according to claim 14, wherein in formula (M), both of $R^{01}$ and $R^{02}$ are a hydrogen atom, or one of $R^{01}$ or $R^{02}$ is a hydrogen atom and the other is a methyl group.

16. The photothermographic material according to claim 1, wherein a mean equivalent spherical diameter of the tabular grains is from 0.3 μm to 8.0 μm.

17. The photothermographic material according to claim 1, further comprising a silver iodide complex-forming agent.

18. The photothermographic material according to claim 1, further comprising a nucleator.

19. The photothermographic material according to claim 1, which comprises the image forming layer and the non-photosensitive layer on both sides of the support.

20. An image forming method comprising: bringing the photothermographic material according to claim 1 into contact with a fluorescent intensifying screen; X-ray imagewise exposing the photothermographic material; and thermal developing the photothermographic material, wherein the fluorescent intensifying screen comprises a fluorescent substance in which 50% or more of the emission light has a wavelength of 350 nm to 420 nm.

* * * * *